US011396722B2

(12) United States Patent
Osamura et al.

(10) Patent No.: US 11,396,722 B2
(45) Date of Patent: Jul. 26, 2022

(54) CAP FRAME

(71) Applicant: BROTHER KOGYO KABUSHIKI KAISHA, Nagoya (JP)

(72) Inventors: Takahira Osamura, Kitanagoya (JP); Yasuhiko Kawaguchi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/995,893

(22) Filed: Aug. 18, 2020

(65) Prior Publication Data

US 2021/0054551 A1 Feb. 25, 2021

(30) Foreign Application Priority Data

Aug. 20, 2019 (JP) ..... JP2019-150442

(51) Int. Cl.
*D05C 9/04* (2006.01)
*D05B 39/00* (2006.01)
*D05C 17/00* (2006.01)

(52) U.S. Cl.
CPC ..... *D05C 9/04* (2013.01); *D05B 39/00* (2013.01); *D05C 17/00* (2013.01)

(58) Field of Classification Search
CPC ... D05C 9/04; D05C 9/10; D05C 1/04; D05C 17/00; D05B 39/00
See application file for complete search history.

(56) References Cited

U.S. PATENT DOCUMENTS 5,553,560 A * 9/1996 Tajima ..... D05B 21/00 112/103
2004/0180987 A1* 9/2004 Ahn ..... D05C 9/04 523/160
2011/0155032 A1* 6/2011 Kawaguchi ..... D05B 39/00 112/103

FOREIGN PATENT DOCUMENTS

DE 19637866 A1 * 3/1998 ..... D05C 9/04
JP 2005-073814 A 3/2005
JP 2006-273095 A 10/2006
JP 2011-132638 A 7/2011

* cited by examiner

*Primary Examiner* — Alissa L Hoey
*Assistant Examiner* — Patrick J. Lynch
(74) *Attorney, Agent, or Firm* — Oliff PLC

(57) ABSTRACT

A cap frame includes a body member including an arc-shaped curved wall extending in a particular direction, a retaining member including a clamping portion made of elastic material and first and second engagement portions disposed at end portions of the clamping portion in the particular direction, and an attaching portion. In a state where the retaining member is attached to the body member, the retaining member holds a cap between the retaining member itself and the body member. The clamping portion is elastically deformed in conformance with the curved wall and presses the cap toward the curved wall. The body member includes third and fourth engagement portions engageable with the first and second engagement portions, respectively, and first and second guide portions that define movable directions of the first and second engagement portions as first and second guide directions, respectively, and their opposite directions.

9 Claims, 16 Drawing Sheets

UP
DOWN
LEFT
RIGHT
W
L
P
F1
F2
Q
L2
L3
5
7
70
733
85
81
80
87
912
915
895
922
925
74
(745)
74(741)
74(740)
76
93
931
91
933
914
911
913
784
936
935
8
932
894
89
864
893
865
892
891
863
86
945
942
946
794
923
921
92
42
943
924
94
941
77

CAP FRAME

CROSS-REFERENCE TO RELATED APPLICATION

This application claims priority from Japanese Patent Application No. 2019-150442 filed on Aug. 20, 2019, the content of which is incorporated herein by reference in its entirety.

TECHNICAL FIELD

Aspects of the disclosure relate to a cap frame for holding a workpiece such as a cap and for use in an embroidery machine.

BACKGROUND

A known cap frame is configured to be attached to an embroidery machine. The cap frame is configured to hold a cap including a visor and a crown such as a baseball cap. The cap frame includes a body member and a retaining member. The body member has a tubular shape. The retaining member is made of material having flexibility. The retaining member has a shape conforming to a shape of the body member and extends along a circumferential direction of the body member. The retaining member is configured to be secured to the body member while receiving a visor of a cap through an opening of the retaining member and being deformed into an arc shape conforming to a crown of the cap in the vicinity of a boundary between the visor and the crown of the cap. More specifically, for example, the retaining member has one end portion and the other end portion in its longitudinal direction. The one end portion of the retaining member is fixed to the body member using a screw. The other end portion of the retaining member is movable between a retaining position and a release position. At the retaining position, the other end portion of the retaining member is in engagement with the body member and the retaining member may hold a cap in cooperation with the body member. At the release position, the other end portion of the retaining member is out of engagement with the body member. For setting a cap to the cap frame, a user places a cap onto the body member while maintaining the other end portion of the retaining member at the release position. Thereafter, the user inserts a visor of the cap into the opening of the retaining member to contact the one end portion and the other end portion of the retaining member to the cap in this order. The user then places the other end portion of the retaining member at the retaining position to engage the other end portion of the retaining member and the body member to each other.

SUMMARY

In the known cap frame, the user may contact the one end portion of the retaining member to the cap and then the other end portion of the retaining member to the cap to engage the retaining member and the body member to each other. Nevertheless, in the above known procedure, the center line of the cap may tend to go out of alignment with the center of the cap frame.

Accordingly, aspects of the disclosure provide a cap frame with respect to which a cylindrical workpiece such as a cap may be brought into alignment with a simpler procedure as compared with the known procedure.

In one or more aspects of the disclosure, a cap frame may include a body member, a retaining member, and an attaching portion. The body member may include a curved wall. The curved wall may have an arc shape and extend in a particular direction. The retaining member may be configured to, in a state where the retaining member is attached to the body member, hold a cap in cooperation with the body member to sandwich the cap therebetween. The retaining member may include a clamping portion, a first engagement portion, and a second engagement portio. The clamping portion may be made of elastic material. The clamping portion may be configured to, in a state where the retaining member is attached to the body member, be elastically deformed in conformance with the curved wall and press, toward the curved wall, the cap sandwiched between the curved wall and the clamping portion. The first engagement portion and the second engagement portion may be disposed at end portions of the clamping portion in the particular direction in a state where the retaining member is attached to the body member. The attaching portion may be disposed at at least one of the body member and the retaining member. The attaching portion may be configured to be removably attached to a moving mechanism of an embroidery machine. The body member may further include a third engagement portion, a fourth engagement portion, a first guide portion, and a second guide portion. The third engagement portion and the fourth engagement portion may be configured to engage the first engagement portion and the second engagement portion, respectively, of the retaining member. The third engagement portion and the fourth engagement portion may be further configured to, in a case where the third engagement portion and the fourth engagement portion are in engagement with the first engagement portion and the second engagement portion, respectively, of the retaining member with the clamping portion conforming to the curved wall, restrict the retaining member and the body member from moving relative to each other, thereby fastening the retaining member to the body member in conformance therewith. The third engagement portion and the fourth engagement portion may be further configured to, in a case where the third engagement portion and the fourth engagement portion are out of engagement with the first engagement portion and the second engagement portion, respectively, of the retaining member, allow the retaining member and the body member to move relative to each other. The first guide portion may define a movable direction of the first engagement portion as a first guide direction toward the third engagement portion and a direction opposite to the first guide direction. The second guide portion may define a movable direction of the second engagement portion as a second guide direction toward the fourth engagement portion and a direction opposite to the second guide direction.

According to the one or more aspects of the disclosure, in the cap frame, engaging the first and second engagement portions of the retaining member to the third and fourth engagement portions, respectively, of the body member may enable the retaining member to be attached to the body member with the retaining member conforming to the shape of the curved wall. Such an attaching manner may thus enable alignment of the cap with respect to the cap frame with a simpler procedure as compared with the known procedure in which a retaining member is attached to a body member with a one end portion of the retaining member fixed to the body member.

DETAILED DESCRIPTION

Figure 1:
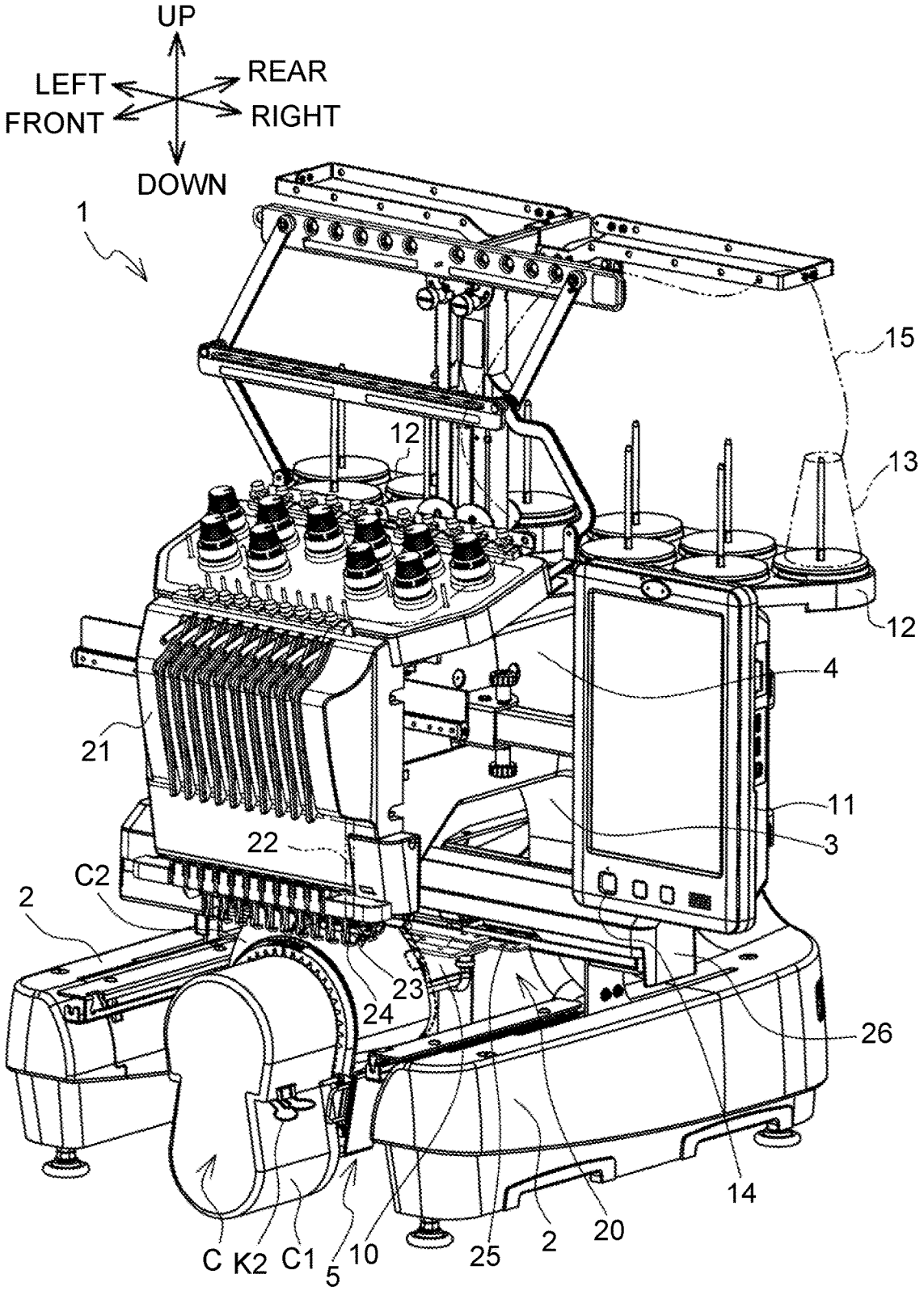
FIG. 1 is a perspective view of a sewing machine in which a cap frame holding a cap is attached to a moving mechanism in an illustrative embodiment according to one or more aspects of the disclosure.
Figure 2:
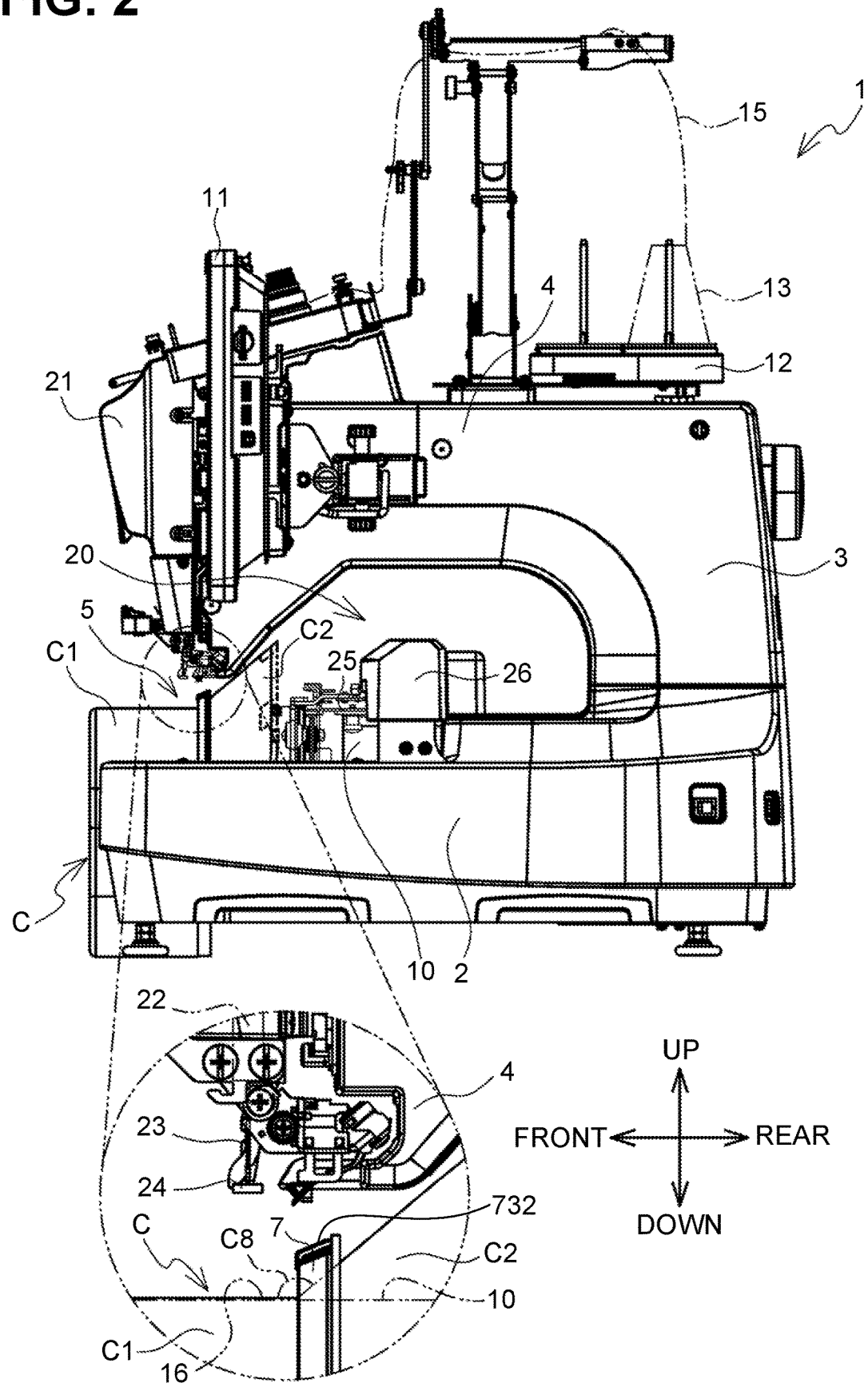
FIG. 2 is a right side view of the sewing machine in which the cap frame holding the cap is attached to the moving mechanism in the illustrative embodiment according to one or more aspects of the disclosure.
Figure 3A:
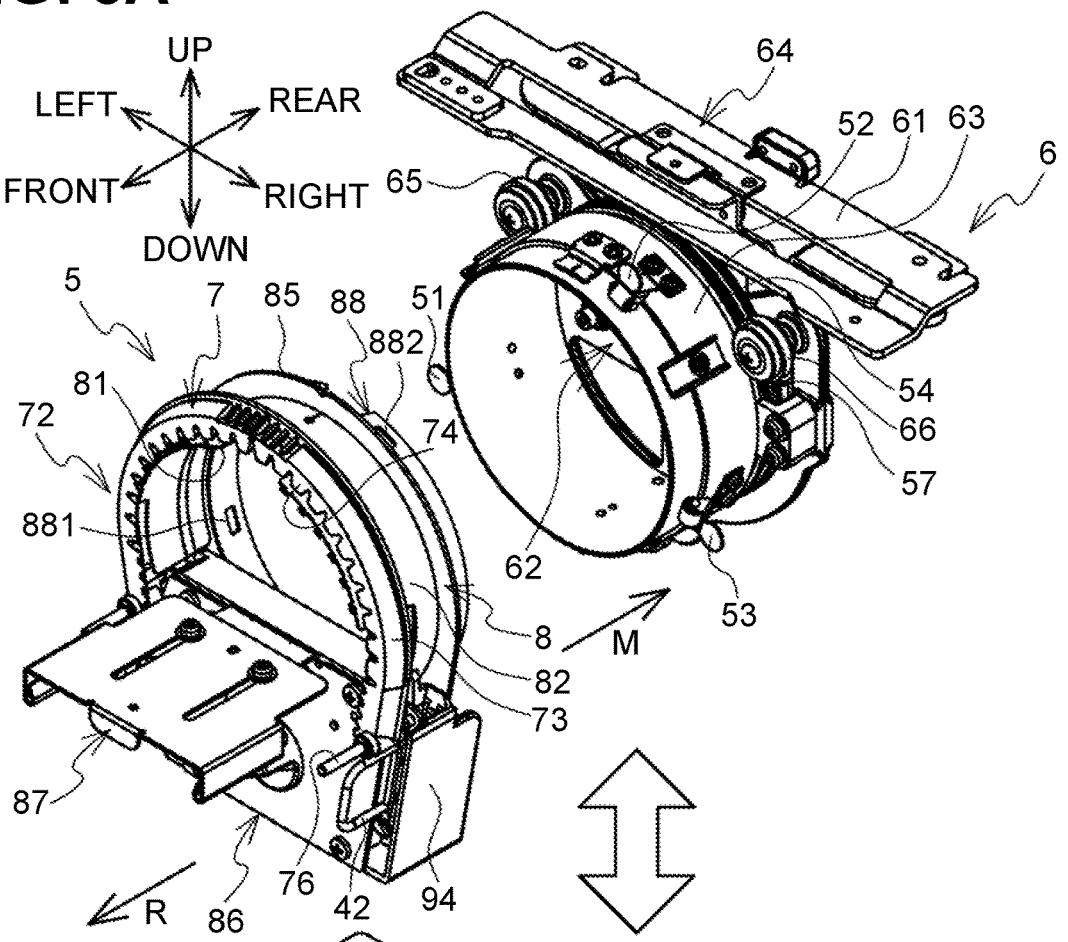
FIG. 3A is a perspective view of the cap frame and a frame unit in the illustrative embodiment according to one or more aspects of the disclosure, wherein the cap frame is located in front of the frame unit.
Figure 3B:
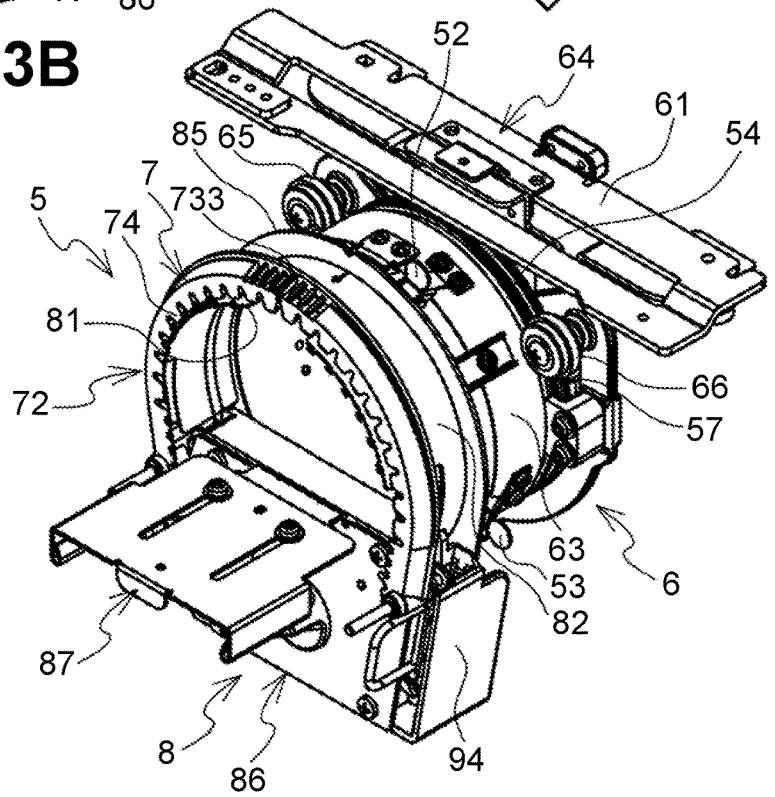
FIG. 3B is a perspective view of the cap frame and the frame unit in the illustrative embodiment according to one or more aspects of the disclosure, wherein the cap frame is attached to the frame unit.

Referring to the accompanying drawings, an illustrative embodiment of the disclosure will now be described. Referring to FIGS. 1 and 2, a description will be provided on a configuration of a multi-needle sewing machine (hereinafter, simply referred to as a "sewing machine") 1 to which a cap frame 5 is removably attachable. In the following description, an upper side, a lower side, a lower left side, an upper right side, an upper left side, and a lower right side of the page of FIG. 1 are defined respectively as upper, lower, front, rear, left, and right sides of the sewing machine 1 and the cap frame 5.

As illustrated in FIGS. 1 and 2, the sewing machine 1 may be an embroidery machine including a plurality of, for example, 10 needle bars 22. The sewing machine 1 includes a base 2, an upright arm 3, and a horizontal arm 4. The base 2 has a substantially U-shape in plan view and supports the entire sewing machine 1. The upright arm 3 extends upward from a rear end portion of the base 2. The horizontal arm 4 extends frontward from an upper end of the upright arm 3. A needle bar case 21 is disposed at a front end of the horizontal arm 4. The needle bar case 21 is movable in a right-left direction. The 10 needle bars 22 extending in an up-down direction and presser bars are aligned in a row and evenly spaced in the right-left direction in the needle bar case 21. The needle bars 22 are each configured such that a needle 23 is removably attachable to a lower end thereof. Presser feet 24 are attached to respective lower ends of the presser bars. Each presser foot 24 is configured to move together with a corresponding presser bar between a lower position at which the presser foot 24 holds a workpiece and an upper position at which the presser foot 24 is located higher than the pressure foot 24 at the lower position and out of contact with the workpiece. A workpiece may be, for example, a cap C including a crown C1 and a visor C2.

As illustrated in FIG. 1, the sewing machine 1 further includes an operation interface 11 including a button 14. The operation interface 11 is disposed at the horizontal arm 4. The button 14 enables a user to provide an instruction to start or stop embroidering. The sewing machine 1 further includes a cylinder bed 10 below the horizontal arm 4. The cylinder bed 10 has a cylindrical shape and extends frontward from a lower end of the upright arm 3. A needle plate 16 is disposed at an upper surface of the cylinder bed 10. The cylinder bed 10 includes inside a rotary hook for accommodating a bobbin around which a lower thread is wound. The needle plate 16 has a needle hole that allows a needle 23 to pass therethrough. The sewing machine 1 further includes a moving mechanism 20 below the horizontal arm 4. The moving mechanism 20 includes a holder 25, a Y-axis motor, a Y-axis carriage 26, an X-axis motor, and an X-axis carriage. The holder 25 is configured such that the cap frame 5 is removably attachable to the holder 25 via a frame unit 6. The cap frame 5 is configured to hold a cap C removably. The moving mechanism 20 is configured to move the cap frame 5 attached to the holder 25 to stop at a particular position represented in a unique X-Y coordinate system (e.g., an embroidery coordinate system). More specifically, for example, the X-axis carriage is connected to the holder 25. The Y-axis carriage 26 supports the X-axis carriage such that the X-axis carriage is movable in an X-axis direction (e.g., the right-left direction). The moving mechanism 20 is configured to move the Y-axis carriage 26 in a Y-axis direction (e.g., a front-rear direction) by driving of the Y-axis motor. The moving mechanism 20 is further configured to move the X-axis carriage in the X-axis direction by driving of the X-axis motor. A pair of right and left spool stands 12 is disposed at an upper surface of a rear portion of the horizontal arm 4. Upper threads 15 are supplied from respective spools 13 mounted on the spool stands 12 and are threaded through eyes of the respective needles 23 attached to the lower ends of the needle bars 22.

Referring to FIGS. 3A, 3B, 4A, 4B, 5A, and 5B, a description will be provided on the frame unit 6 to which the cap frame 5 is removably attachable. The frame unit 6 includes a movable member 61, a main body frame 62, rollers 65, 66, and 67, a rotary frame 63, a rotary mechanism 64, and screws 68 and 69. The movable member 61 may have a rectangular shape elongated in the right-left direction. The movable member 61 may be made of metal (e.g., aluminum alloy). The main body frame 62 may be a plate-like member made of metal (e.g., aluminum alloy). The main body frame 62 is disposed below the movable member 61 and extends in both the right-left direction and the up-down direction. The main body frame 62 has a hole 621 (refer to FIG. 5A) penetrating therethrough in the front-rear direction. The rollers 65, 66, and 67 may be made of resin material (e.g., acetal resin ("POM")). The rollers 65, 66, and 67 are supported by a front surface of the main body frame 62 with their axes extending in the front-rear direction. The rotary frame 63 may be a tubular member made of metal (e.g., aluminum alloy). The rotary frame 63 includes a guide groove 54, engagement brackets 51, 52, and 53, and a roller groove 57 at its outer circumference. The guide groove 54 may be an annular groove defined in the outer circumference of the rotary frame 63. The engagement brackets 51, 52, and 53 are configured to, in a state where the cap frame 5 is attached to a front end portion of the rotary frame 63, be engaged with engagement portions 881, 882, and 883, respectively, of the cap frame 5. The engagement brackets 51, 52, and 53 enable the cap frame 5 to be removably attached to the rotary frame 63. The roller groove 57 may be an annular groove. The roller groove 57 is engaged with the rollers 65, 66, and 67. The outer circumference of the rotary frame 63 is in contact with outer circumferences of the rollers 65, 66, and 67. The rotary frame 63 is supported by the rollers 65, 66, and 67 so as to be rotatable on an imaginary axis J extending in the front-rear direction. The rotary frame 63 has a diameter less than a dimension of the movable member 61 in the right-left direction. In a state where the frame unit 6 is attached to the sewing machine 1, the cylinder bed 10 of the sewing machine 1 extends through the hole 621 of the main body frame 62 and the rotary frame 63.

The rotary mechanism 64 includes a sting-like wire 59. The rotary mechanism 64 is configured to convert movement of the holder 25 in the right-left direction into rotation of the rotary frame 63 on the imaginary axis J via the wire 59. The wire 59 is wound around the rotary frame 63 in the guide groove 54. The wire 59 has ends 591 and 592 connected to right and left end portions, respectively, of the movable member 61. As the holder 25 moves in the right-left direction, the movable member 61 moves in the right-left direction together with the holder 25 and relative to the main body frame 62 and the rotary frame 63. At that time, the wire 59 of which the ends 591 and 592 are connected to the movable member 61 also moves in the right-left direction, thereby causing the rotary frame 63 to rotate on the imaginary axis J by a particular angle correspondingly. The screws 68 and 69 are screwed into the movable member 61 and the holder 25 from below to removably fasten the frame unit 6 to the holder 25 of the moving mechanism 20.

Referring to FIGS. 3A to 12, the cap frame 5 will be described. In the description below, a direction in which the cap frame 5 is moved relative to the sewing machine 1 for attaching the cap frame 5 to the sewing machine 1 via the frame unit 6 may be referred to as an attaching direction M (e.g., a rearward direction). A direction in which the cap frame 5 is moved relative to the sewing machine 1 for removing the cap frame 5 from the sewing machine 1 may be referred to as a removing direction R (e.g., a frontward direction). The removing direction R may be a direction from one side of the cap frame 5, in which an attaching portion 88 of a body member 8 may be provided, to the other side of the cap frame 5, in which a curved wall 81 of the body member 8 may be provided. The attaching direction M may be opposite to the removing direction R. That is, the attaching direction M may be a direction from the other side of the cap frame 5, in which the curved wall 81 of the body member 8 may be provided, to the one side of cap frame 5, in which the attaching portion 88 of the body member 8 may be provided. Thus, in the illustrative embodiment, a direction in which the cap frame 5 is attached to and removed from the sewing machine 1 may correspond to the front-rear direction. The cap frame 5 may be a hoopless frame that might not have an embroidery hoop for defining an embroidery area where the sewing machine 1 can embroider a pattern on a crown C1 of a cap C held by the cap frame 5. The cap frame 5 includes a retaining member 7 and the body member 8. The retaining member 7 and the body member 8 may hold a cap C by sandwiching therebetween a boundary C3 (refer to FIG. 15) between a crown C1 and a visor C2 of the cap C. In the illustrative embodiment, the cap frame 5 has a substantially mirror-symmetrical structure with respect to a plane E (refer to FIG. 9) extending in both the front-rear direction and the up-down direction and passing through the imaginary axis J in a state where the cap frame 5 is attached to the frame unit 6. In the following description, therefore, one of right and left halves of the cap frame 5 will be described in detail and a description of the other half will be omitted.

Referring to FIGS. 3A to 8B, the body member 8 may be made of, for example, metal plate such as steel plate cold commercial ("SPCC"). The body member 8 includes curved walls 81 and 82, a flange 85, and the attaching portion 88. The body member 8 further includes a casing 86, engagement portions 91 and 92, guide portions 93 and 94, a switch member 89, an attaching frame 87. The curved walls 81 and 82 are each curved into an arc shape. As illustrated in FIG. 5A, when viewed from the front, shapes of the curved walls 81 and 82 coincide with an arc of an imaginary circle K having the imaginary axis J as its center. That is, the curved walls 81 and 82 extend in a circumferential direction D (an example of a particular direction) of the circle K. The curved wall 81 has end portions in the circumferential direction D. A maximum distance L1 between the end portions of the curved wall 81 in a width direction W of the cap frame 5 may preferably be less than a diameter (e.g., between 16 cm and 20 cm) of a crown C1 of a cap C, and more preferably, 13 cm or less. The width direction W (e.g., the right-left direction) is orthogonal to the attaching direction M (e.g., the rearward direction) and a convex direction P (e.g., an upward direction) of the curved wall 81 toward which the curved wall 81 is convex. In the illustrative embodiment, the maximum distance L1 may be a distance between particular points of the respective end portions of the curved wall 81 in the right-left direction at a level corresponding to the imaginary axis J in the up-down direction. That is, in the illustrative embodiment, the maximum distance L1 may correspond to the diameter of the circle K coinciding with the shape of the curved wall 81 in front view.

Figure 4A:
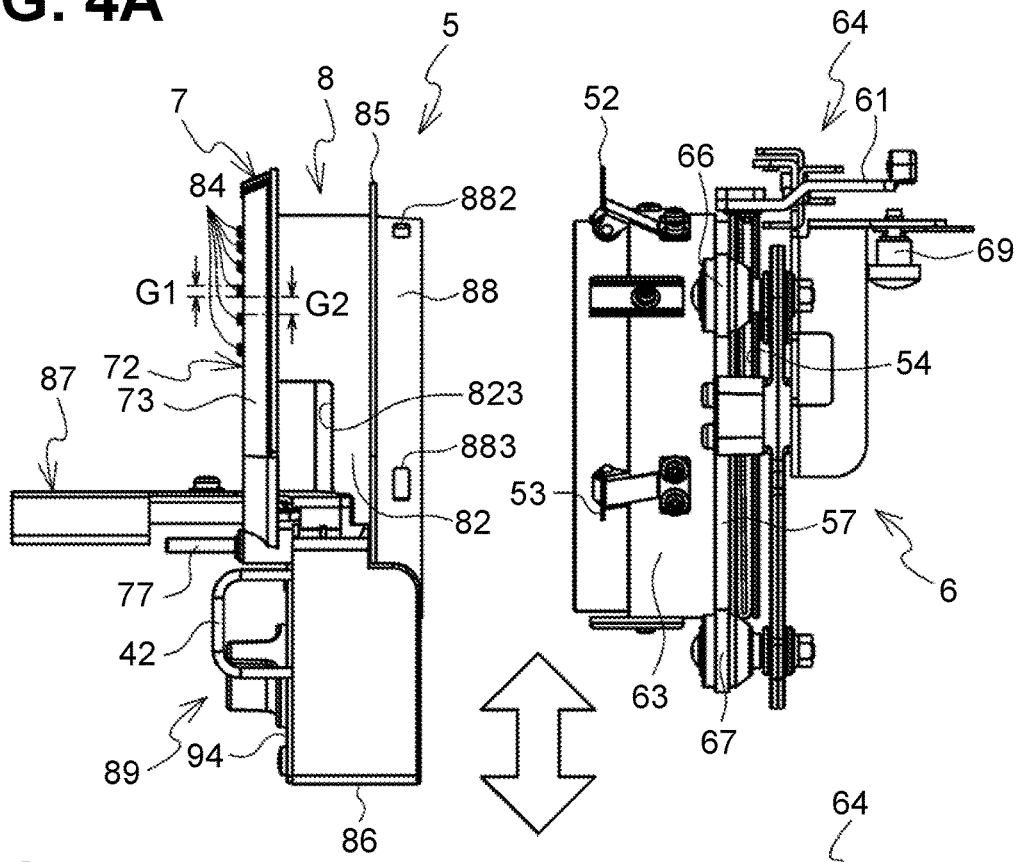
FIG. 4A is a right side view of the cap frame and the frame unit in the illustrative embodiment according to one or more aspects of the disclosure, wherein the cap frame is located in front of the frame unit.
Figure 4B:
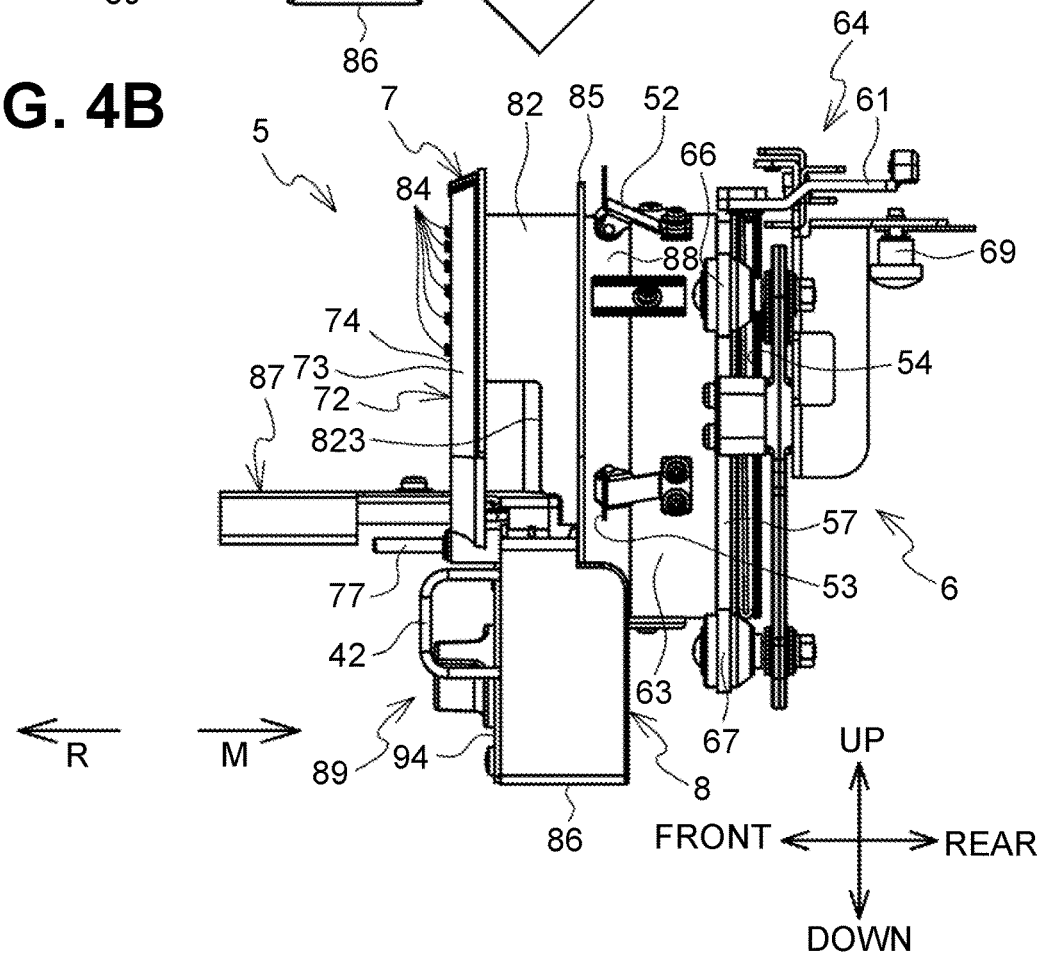
FIG. 4B is a right side view of the cap frame and the frame unit in the illustrative embodiment according to one or more aspects of the disclosure, wherein the cap frame is attached to the frame unit.
Figure 6:
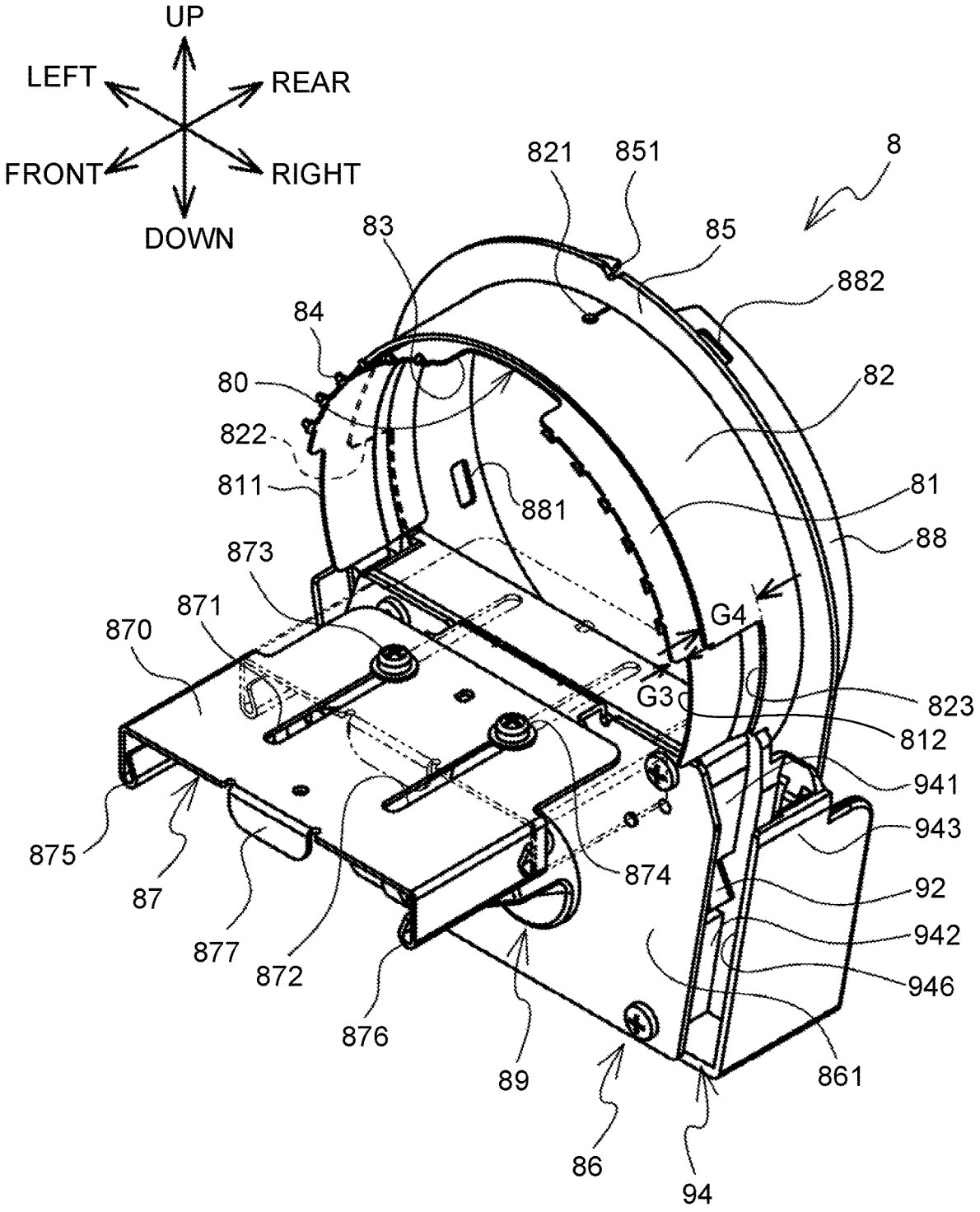
FIG. 6 is a perspective view of a body member of the cap frame in the illustrative embodiment according to one or more aspects of the disclosure.

As illustrated in FIG. 6, the curved wall 81 has recessed portions 83, 811, and 812 and a plurality of hooks 84. The recessed portion 83 is defined in a particular portion of the curved wall 81. The particular portion includes a center 80 of the curved wall 81 in the circumferential direction D. The recessed portion 83 may be a cutout extending in the attaching direction M from a leading end of the curved wall 81 in the removing direction R (e.g., a front end of the curved wall 81). The recessed portions 811 and 812 are defined in the respective end portions of the curved wall 81 in the circumferential direction D. The recessed portions 811 and 812 may each be a cutout extending in the attaching direction M from the leading end of the curved wall 81 in the removing direction R (e.g., the front end of the curved wall 81). A bottom of the recessed portion 83 is positioned further to the rear than bottoms of the recessed portions 811 and 812 in the front-rear direction. The curved wall 81 has, within its extension range, a particular section between the recessed portions 83 and 811 in the circumferential direction D. An extension range of the particular section is greater than an extension range of the recessed portion 811 in the circumferential direction D. The curved wall 81 further has, within its extension range, a further particular section between the recessed portions 83 and 812 in the circumferential direction D. An extension range of the further particular section is greater than an extension range of the recessed portion 812 in the circumferential direction D. The extension range of each of the recessed portions 811 and 812 is greater than an extension range of the recessed portion 83 in the circumferential direction D. In a state where the cap frame 5 is attached to the sewing machine 1 via the frame unit 6, an embroidery area is defined at a position corresponding to an area between the recessed portion 811 and the recessed portion 812 within the extension range of the curved wall 81 in the circumferential direction D. The hooks 84 of the curved wall 81 are disposed at leading ends of the portions (e.g., the particular portion and the further particular portion) of the curved wall 81 in the removing direction R other than the portions where the recessed portions 83, 811, and 812 are defined. The hooks 84 may be bent portions extending in a radial direction of the curved wall 81 from the leading end of the curved wall 81 in the removing direction R. The radial direction of the curved wall 81 includes directions extending radially away from the imaginary axis J of the curved wall 81. As illustrated in FIG. 4A, a dimension G1 of each hook 84 in the circumferential direction D is smaller than an interval G2 between adjacent hooks 84.

A front end of the curved wall 82 coincides with the bottom of the recessed portion 83 of the curved wall 81 in the front-rear direction and is positioned further to the rear than the bottoms of the recessed portion 811 and 812 in the front-rear direction. An inner circumference of the curved wall 82 is in contact with an outer circumference of a rear end portion of the curved wall 81. The curved wall 82 has a mark 821 and recessed portions 822 and 823. The mark 821 is provided at the center of the curved wall 82 in the circumferential direction D. The mark 821 is used as a reference for alignment of a cap C with respect to the cap frame 5. The mark 821 may be a pattern that may be a combination of a circle and a straight line. The recessed portions 822 and 823 are defined in the curved wall 82 at respective positions corresponding to the recessed portions 811 and 812, respectively, in the up-down direction. The recessed portions 822 and 823 may each be a cutout extending in the attaching direction M from a leading end of the curved wall 82 in the removing direction R. As illustrated in FIG. 6, a recessed amount G4 of each of the recessed portions 822 and 823 in the front-rear direction is greater than a recessed amount G3 of each of the recessed portions 811 and 812 in the front-rear direction.

Figure 7:
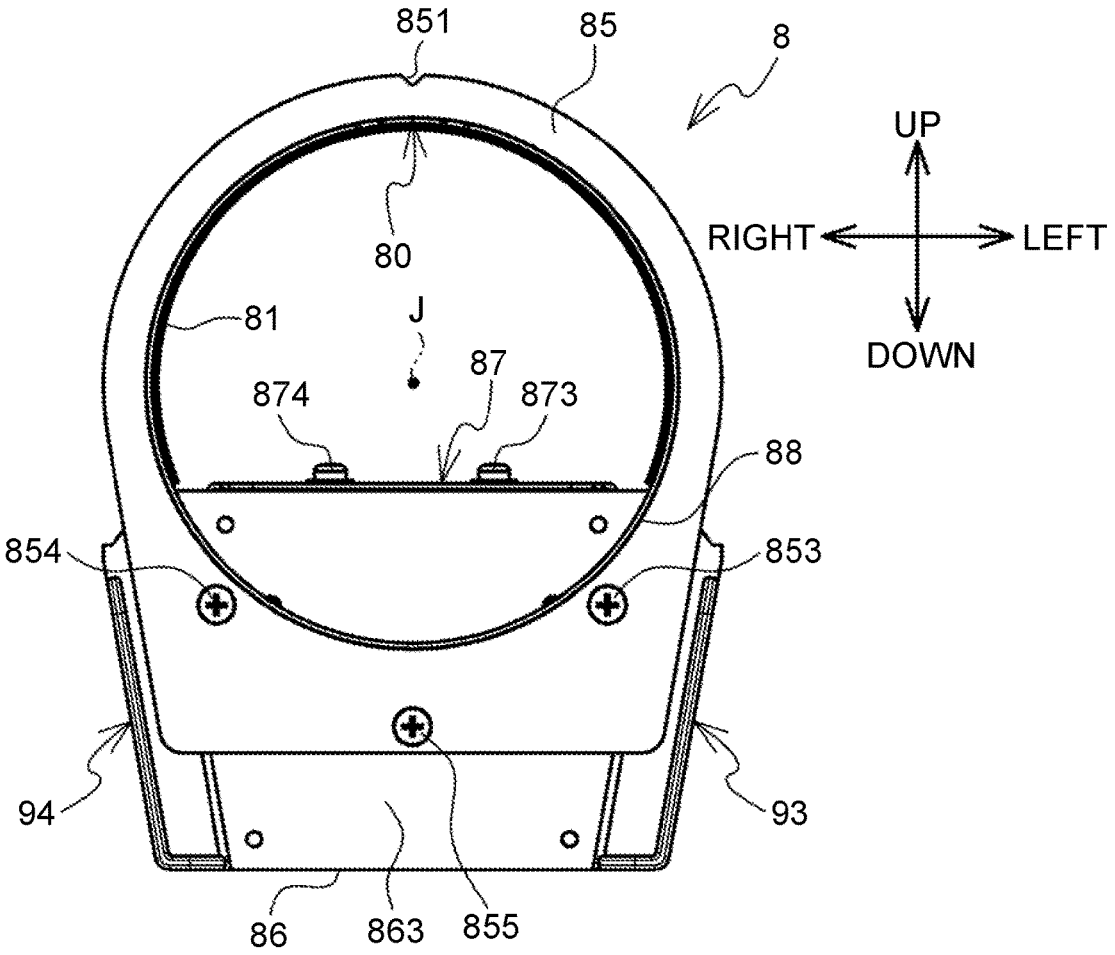
FIG. 7 is a rear view of the body member of the cap frame in the illustrative embodiment according to one or more aspects of the disclosure.

As illustrated in FIGS. 4A, 6, and 7, the attaching portion 88 is disposed behind the curved wall 82. The attaching portion 88 may have a tubular shape. When viewed from the rear, the attaching portion 88 has a circular shape. A circle representing the attaching portion 88 has the center coinciding with the imaginary axis J. The attaching portion 88 includes the engagement portions 881, 882, and 883. The engagement portions 881, 882, and 883 may be rectangular through holes. The engagement portions 881, 882, and 883 are configured to engage the engagement brackets 51, 52, and 53, respectively, of the frame unit 6. The flange 85 is disposed at a boundary between the curved wall 82 and the attaching portion 88 in the front-rear direction. The flange 85 protrudes from the curved wall 82 in the radial direction. The flange 85 has a mark 851 at a position corresponding to the mark 821 of the curved wall 82. As with the mark 821, the mark 851 is used as a reference for alignment of a cap C with respect to the cap frame 5. The mark 851 may be a notch having a V shape in front view. The V-notch mark 851 extends toward the imaginary axis J (e.g., downward) from a circumference of the flange 85. As illustrated in FIG. 7, the flange 85 includes a lower portion fastened to the casing 86 with screws 853, 854, and 855. In a state where the cap frame 5 is attached to the sewing machine 1 via the frame unit 6, the cylinder bed 10 of the sewing machine 1 extends through the attaching portion 88.

Figure 5A:
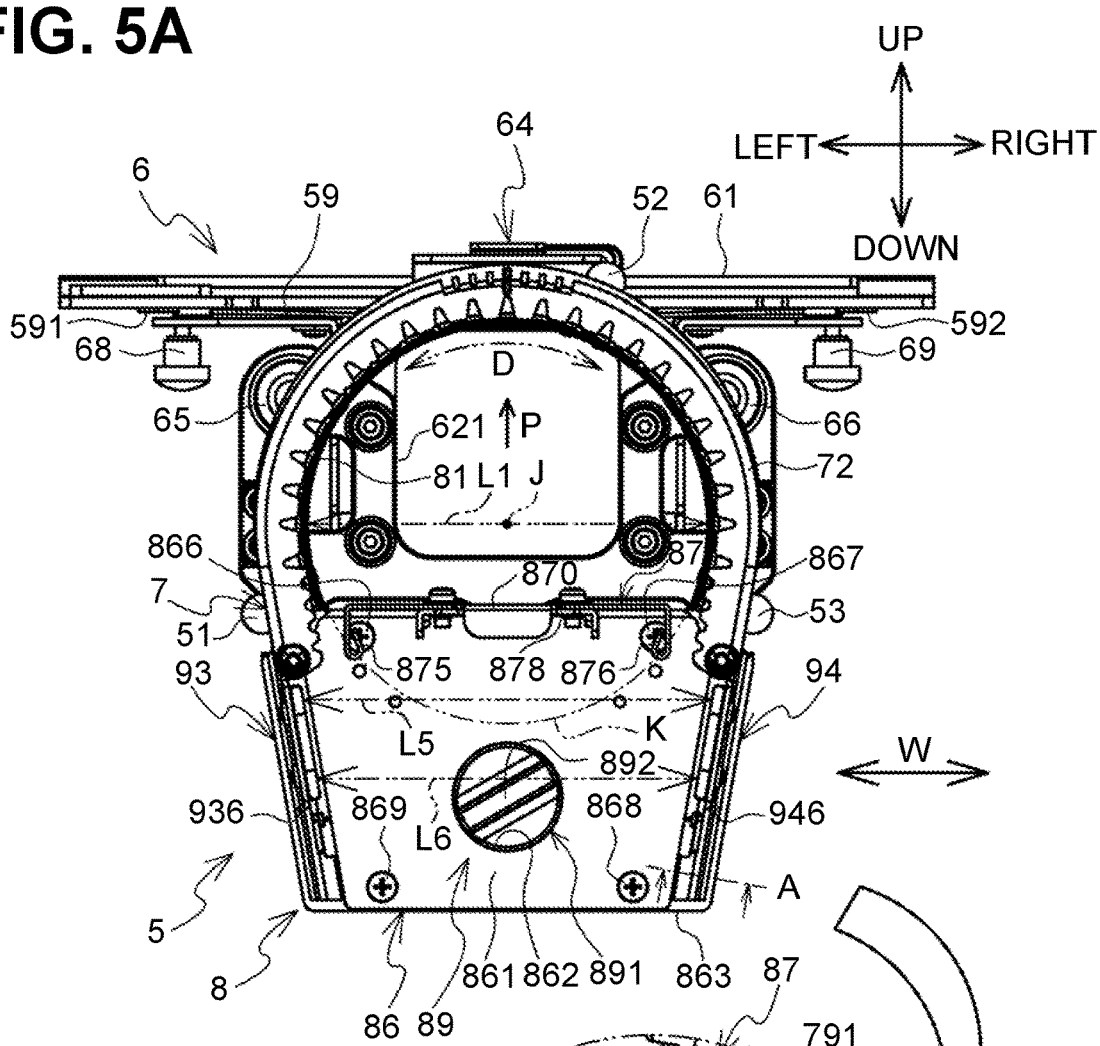
FIG. 5A is a front view of the cap frame and the frame unit in the illustrative embodiment according to one or more aspects of the disclosure, wherein the cap frame is attached to the frame unit.
Figures 8A, 8B:
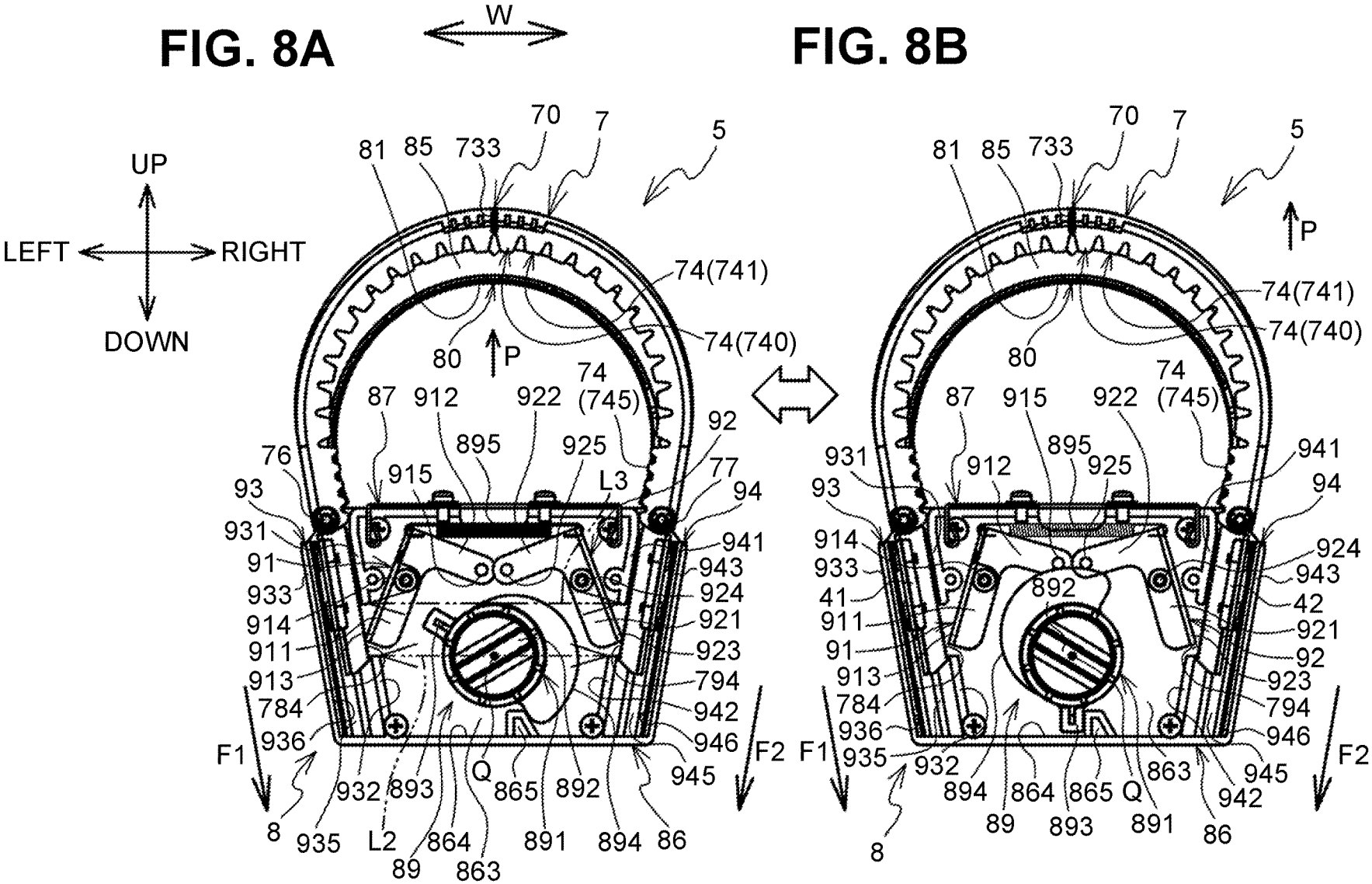
FIG. 8A is a front view of the cap frame including engagement portions and a switch member in the illustrative embodiment according to one or more aspects of the disclosure, wherein the engagement portions are located at respective engaged positions.
FIG. 8B is a front view of the cap frame including the engagement portions and the switch member in the illustrative embodiment according to one or more aspects of the disclosure, wherein the engagement portions are located at respective disengaged positions.

As illustrated in FIGS. 5A, 8A and 8B, the casing 86 may be a box having an inverted trapezoid shape in front view. The casing 86 is disposed below the curved walls 81 and 82. The casing 86 includes a plate member 861, an accommodating portion 863, and a contact portion 865. The plate member 861 has a through hole 862 having a circular shape in front view. In FIG. 8, the plate member 861 is not illustrated. The accommodating portion 863 may be a box-shaped member with its front end opened. As illustrated in FIG. 5A, the plate member 861 is fastened to the accommodating portion 863 with screws 866, 867, 868, and 869 with an operating portion 891 of the switch member 89 passing through the through hole 862. The contact portion 865 protrudes from a bottom surface 864 of the accommodating portion 863. The contact portion 865 is disposed offset to the right from the center of the bottom surface 864 in the right-left direction.

As illustrated in FIGS. 8A and 8B, the engagement portions 91 and 92 are accommodated in the casing 86 and configured to engage engagement portions 78 and 79 (refer to FIG. 9) of the retaining member 7. More specifically, for example, the retaining member 7 includes a clamping portion 72. The engagement portions 91 and 92 are configured to, in a state where the clamping portion 72 is positioned extending along the curved wall 81, be engaged with the respective corresponding engagement portions 78 and 79. The engagement portions 91 and 92 are configured to, in a case where the engagement portions 91 and 92 of the casing 86 are in engagement with the respective engagement portions 78 and 79, restrict the retaining member 7 and the body member 8 from moving relative to each other with respect to guide directions F1 and F2, thereby fastening the retaining member to the body member in conformance with the body member. The engagement portions 91 and 92 are further configured to, in a case where the engagement portions 91 and 92 are out of engagement with the respective engagement portions 78 and 79, allow the retaining member 7 to move relative to the body member 8 in the guide directions F1 and F2 and in their opposite directions. The engagement portions 91 and 92 are mirror images of each other and symmetrically disposed right and left with respect to the plane E (refer to FIG. 9). The engagement portion 91 may be a plate-like member having an inverted L-shape. The engagement portion 91 includes a longer portion 911 and a shorter portion 912. The longer portion 911 obliquely extends from the upper right to the lower left in front view. The shorter portion 912 obliquely extends from an upper end of the longer portion 911 to the lower right. The longer portion 911 has a U shape in cross section opening downward and to the right. The longer portion 911 has a lower end portion serving as a ratchet pawl 913. The engagement portion 91 is pivotably supported by the casing 86 via a shaft 914 extending in the front-rear direction. The shaft 914 may be made of metal (e.g., SUM23 specified in JIS (Japanese Industrial standard): Free-cutting steels). The engagement portion 91 further includes a protrusion 915 protruding from a right end portion of a front surface of the shorter portion 912.

As with the engagement portion 91, the engagement portion 92 may be a plate-like member having an inverted L-shape. The engagement portion 92 includes a longer portion 921 and a shorter portion 922. The longer portion 921 has a U shape in cross section opening downward and to the left. The longer portion 921 has a lower end portion serving as a ratchet pawl 923. The engagement portion 92 is pivotably supported by the casing 86 via a shaft 924 extending in the front-rear direction. The engagement portion 92 further includes a protrusion 925 protruding from a left end portion of a front surface of the shorter portion 922. The engagement portion 91 is configured to engage the engagement portion 78 at one of a plurality of engagement positions. The engagement portion 92 is configured to engage the engagement portion 79 at one of a plurality of engagement positions. Thus, the retaining member 7 and the body member 8 are allowed to be located at one of a plurality of relative positions.

The guide portion 93 is disposed at a left portion of the casing 86. The guide portion 94 is disposed at a right portion of the casing 86. The guide portion 93 is configured to guide the engagement portion 78. The guide portion 93 defines a movable direction of the engagement portion 78 as the guide direction F1 (e.g., from upper left to lower right) and its opposite direction. The guide direction F1 may be a direction in which the engagement portion 78 moves toward the engagement portion 91. The guide portion 94 is configured to guide the engagement portion 79. The guide portion 94 defines a movable direction of the engagement portion 79 as the guide direction F2 (e.g., from upper right to lower left) and its opposite direction. The guide direction F2 may be a direction in which the engagement portion 79 moves toward the engagement portion 92. The guide portion 93 includes walls 931, 932, 933, and 935 and a slit 936. The walls 931, 932, 933, and 935 and the slit 936 extend along the guide direction F1. The wall 933 may be a left wall of the casing 86. The walls 931 and 932 are spaced from each other in the up-down direction. The walls 931 and 932 are disposed to the right of the wall 933 and extend parallel to the wall 933. The wall 935 may be a rear wall of the guide portion 93. The slit 936 is defined in a front portion of the guide portion 93. The silt 936 extends along the guide direction F1 and has an opening that opens to the front. The ratchet pawl 913 of the engagement portion 91 is located between the walls 931 and 932 in the up-down direction. The wall 931 is disposed above the wall 932.

The guide portion 94 includes walls 941, 942, 943, and 945 and a slit 946. The walls 941, 942, 943, and 945 and the slit 946 extend along the guide direction F2. The wall 943 may be a right wall of the casing 86. The walls 941 and 942 are spaced from each other in the up-down direction. The walls 941 and 942 are disposed to the left of the wall 943 and extend parallel to the wall 943. The wall 941 is disposed above the wall 942. The ratchet pawl 923 of the engagement portion 92 is located between the walls 941 and 942 in the up-down direction. The wall 945 may be a rear wall of the guide portion 94. The slit 946 is defined in a front portion of the guide portion 94. The silt 946 extends along the guide direction F2 and has an opening that opens to the front. A distance between the guide portions 93 and 94 in the width direction W (e.g., the right-left direction) decreases as the guide portions 93 and 94 extend in a direction (e.g., the downward direction) opposite to the convex direction P (e.g., the upward direction). More specifically, for example, as illustrated in FIG. 8A, a maximum distance L2 between the walls 932 and 942 in the right-left direction is shorter than a minimum distance L3 between the walls 931 and 941 in the right-left direction. The walls 931 and 941 are located higher than the walls 932 and 942.

As illustrated in FIGS. 5A, 8A, and 8B, the switch member 89 is configured to change the respective positions of the engagement portions 91 and 92 between an engaged position (refer to FIG. 8A) and a disengaged position (refer to FIG. 8B). When the engagement portions 91 and 92 are located at the respective engaged positions, the engagement portions 91 and 92 are capable of engaging the engagement portions 78 and 79, respectively. When the engagement portions 91 and 92 are located at the respective disengaged positions, the engagement portions 91 and 92 are incapable of engaging the engagement portions 78 and 79, respectively. In the illustrative embodiment, the switch member 89 includes the operating portion 891, an eccentric cam 894, and an urging member 895. The operating portion 891 protrudes frontward beyond the plate member 861 of the casing 86. The operating portion 891 may be a disk dial rotatable on a shaft Q extending in the front-rear direction. The operating portion 891 includes a knob 892 and a protrusion 893. The knob 892 is disposed at a front surface of the operating portion 891. The knob 892 may be a plate-like member protruding frontward. The protrusion 893 protrudes from a periphery of the operating portion 891 in a radial direction of the operating portion 891. The eccentric cam 894 and the urging member 895 are accommodated in the casing 86. The eccentric cam 894 is disposed further to the rear than the operating portion 891. The eccentric cam 894 is coaxially fixed to the shaft Q supporting the operating portion 891 so as to be rotatable together with the operating portion 891. A particular portion of a periphery of the eccentric cam 894 is farther from the shaft Q than the periphery of the operating portion 891 is from the shaft Q in the radial direction. In other words, the particular portion of the periphery of the eccentric cam 894 protrudes relative to the periphery of the operating portion 891 in the radial direction. The urging member 895 may be a tension coil spring. The urging member 895 has a left end and a right end. The left end of the urging member 895 is fixed to a corner of the L-shaped engagement portion 91 where the longer portion 911 and the shorter portion 912 meet. The right end of the urging member 895 is fixed to a corner of the L-shaped engagement portion 92 where the longer portion 921 and the shorter portion 922 meet.

The switch member 89 is configured to change the respective positions of the engagement portions 91 and 92 between the engaged position (refer to FIG. 8A) and the disengaged position (refer to FIG. 8B) in accordance with a user's operation on the operating portion 891. Hereinafter, a description will be provided on how the switch member 89 behaves when viewed from the front. The operating portion 891 is configured to rotate on the shaft Q between a particular position at which the operating portion 891 is in a first state (refer to FIG. 8A) and a further particular position at which the operating portion 891 is in a second state (refer to FIG. 8B). When the operating portion 891 is in the first state, the engagement portions 91 and 92 are located at the respective engaged positions. When the operating portion 891 is in the second state, the engagement portions 91 and 92 are located at the respective disengaged positions. In a case where the operating portion 891 is in the first state, the eccentric cam 894 is in contact with the contact portion 865 of the casing 86 from the right. Thus, further clockwise rotation of the operating portion 891 is restricted by the contact portion 865. In such a state, the eccentric cam 894 is out of contact with the engagement portions 91 and 92. The operating portion 891 is thus free from forces of the engagement portions 91 and 92. In response to the operating portion 891 being rotated counterclockwise from the particular position where the operating portion 891 is in the first state, the particular portion of the periphery of the eccentric cam 894 comes into contact with the protrusion 915 of the engagement portion 91 and the protrusion 925 of the engagement portion 92 in accordance with the state change of the operating portion 891.

In response to the operating portion 891 being further rotated counterclockwise, the eccentric cam 894 presses the protrusions 915 and 925 upward. In response to this, the engagement portion 91 pivots on the shaft 914 against an urging force of the urging member 895 and the ratchet pawl 913 of the engagement portion 91 is thus located further to the right and lower than the ratchet pawl 913 of the engagement portion 91 located at the engaged position. The engagement portion 92 pivots on the shaft 924 against an urging force of the urging member 895 and the ratchet pawl 923 of the engagement portion 92 is thus located further to the left and lower than the ratchet pawl 923 of the engagement portion 92 located at the engaged position. In response to the operating portion 891 being further rotated counterclockwise, as illustrated in FIG. 8B, the protrusion 893 of the operating portion 891 comes into contact with the contact portion 865 of the casing 86 from the left. Thus, further counterclockwise rotation of the operating portion 891 is restricted by the contact portion 865. In a case where the operating portion 891 is in the second state, the operating portion 891 receives downward forces from the engagement portions 91 and 92. After a user's operation on the operating portion 891 is finished, the operating portion 891 is thus maintained in the second state without rotating on the shaft Q. In a case where the engagement portions 91 and 92 are located at the respective disengaged positions, the engagement portions 91 and 92 are separate from the engagement portions 78 and 79, respectively and thus not allowed to engage the respective corresponding engagement portions 78 and 79. Consequently, the engagement portions 78 and 79 are allowed to move in the respective directions opposite to the guide directions F1 and F2. In a case where the switch member 89 is operated for changing the respective positions of the engagement portions 91 and 92 from the engaged position to the disengaged position, the switch member 89 may behave in reverse order to the above-described order, and therefore, a description will be omitted for the switch member 89 behaving in the reverse order.

Figure 9:
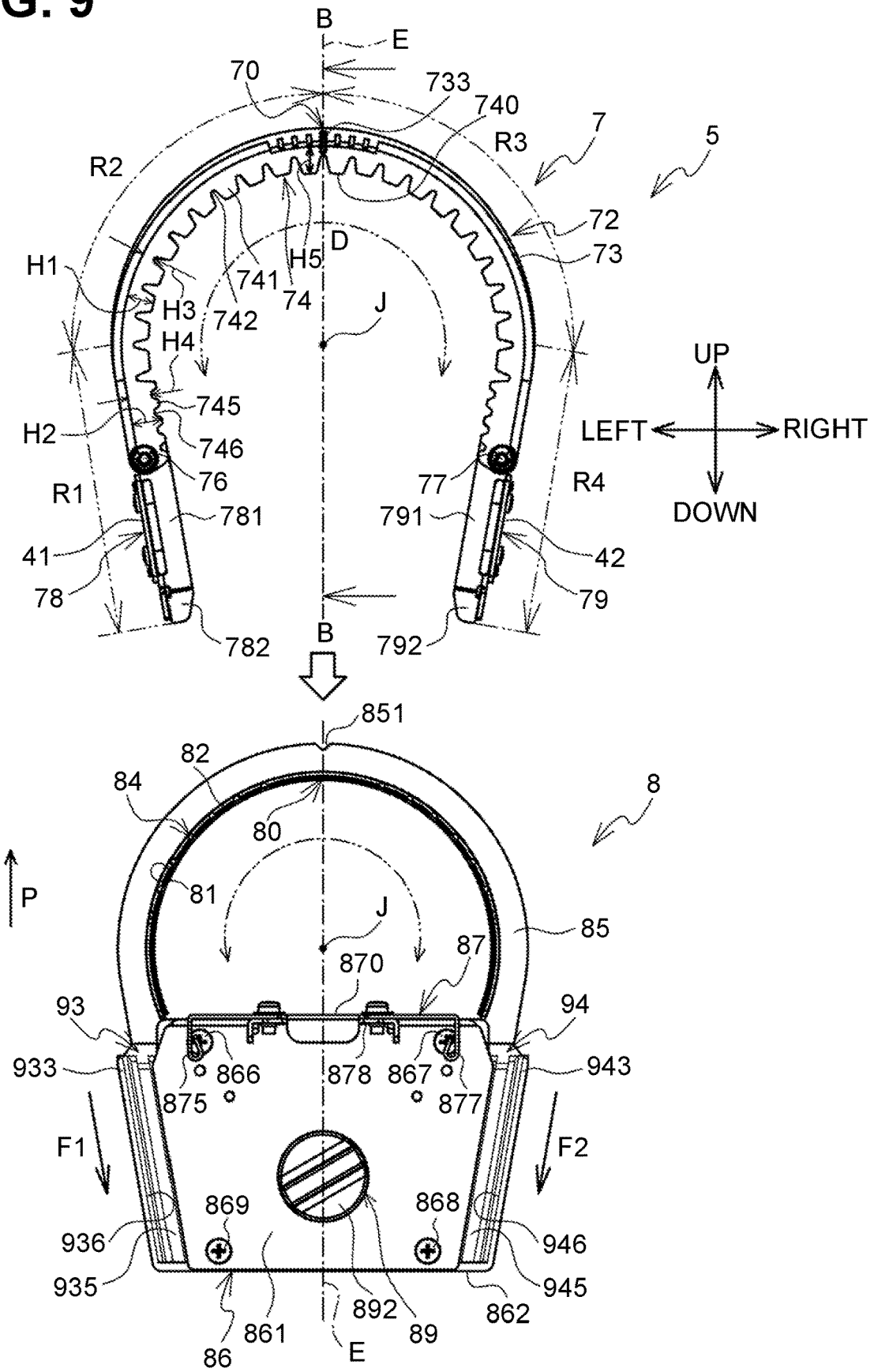
FIG. 9 is a front view of the cap frame in the illustrative embodiment according to one or more aspects of the disclosure, wherein the retaining member is located above the body member.

As illustrated in FIGS. 5A and 9, the attaching frame 87 may be a rectangular plate member extending in a horizontal direction. The attaching frame 87 may be used in a case where a crown C1 of a cap C to be sandwiched by the retaining member 7 and the body member 8 is clipped to the attaching frame 87 using clips K1 and K2 to fasten the cap C to the body member 8 (refer to FIG. 16). The attaching frame 87 is disposed between the right and left ends of the curved walls 81 and 82 in the right-left direction and below the imaginary axis J in the up-down direction. The attaching frame 87 includes a body portion 870 and a support portion 878. The body portion 870 is supported by the support portion 878 such that the position of the body portion 870 is adjustable in the front-rear direction. More specifically, for example, the body portion 870 has slits 871 and 872 and further includes fastening portions 875 and 876 and a bent portion 877. The body portion 870 is attached to the support portion 878 using screws 873 and 874 through the slits 871 and 872 such that the position of the body portion 870 is adjustable in the front-rear direction. The fastening portion 875 may be a left end portion of the body portion 870 bent downward into an L shape. The fastening portion 876 may be a right end portion of the body portion 870 bent downward into an L shape. For example, particular portions of a crown C1 of a cap C held by the cap frame 5 may be clipped, using the clips K1 and K2, to the fastening portions 875 and 876, respectively, to maintain the crown C1 under tension in the circumferential direction D. The particular portions of the crown C1 of the cap C clipped by the clips K1 and K2 may face respective end portions of the clamping portion 72 in the circumferential direction D. The bent portion 877 may be a front end portion of the body portion 870 bent downward. The bent portion 877 is disposed at a middle portion of the front end of the body portion 870 in the right-left direction. The bent portion 877 may be held by the user. The bent portion 877 enables the user to adjust the position of the attaching frame 87 in the front-rear direction between a position indicated by a solid line in FIG. 6 and another position indicated by a double-dotted-and-dashed line in FIG. 6 in accordance with a dimension of a crown C1 in the front-rear direction.

As illustrated in FIGS. 9 to 12, the retaining member 7 is configured to, in a state where the retaining member 7 is attached to the body member 8, hold the cap C together with the body member 8 such that the retaining member 7 and the body member 8 sandwich the cap C therebetween. The retaining member 7 is deformable and detachably attachable to the body member 8. Hereinafter, a description will be provided on a configuration of the retaining member 7 that is attached to the body member 8. The retaining member 7 includes the clamping portion 72, the engagement portions 78 and 79, and shafts 76 and 77. The clamping portion 72 may be made of elastic material (e.g., polyamide resin (PA)). In a state where the retaining member 7 is attached to the body member 8, the clamping portion 72 elastically deforms in conformance with the shape of the curved wall 81 and presses, toward the curved wall 81, the cap C positioned between the retaining member 7 and the body member 8. The clamping portion 72 includes a facing portion 73, a plurality of protrusions 74, and support portions 721 and 722. The facing portion 73 is configured to face the curved wall 81 of the body member 8. The facing portion 73 has the center 70 in the circumferential direction D. The center 70 also serves as the center of the retaining member 7 in the circumferential direction D and the center of the clamping portion 72 in the circumferential direction D. The facing portion 73 includes a first surface 731, a second surface 732, a mark 733, and a plurality of ribs 734.

The facing portion 73 has the first surface 731 on one side thereof facing the body member 8. As the first surface 731 extends in the removing direction R, the first surface 731 is inclined toward the body member 8. The facing portion 73 has the second surface 732 on the other side thereof opposite to the one side thereof. That is, the second surface 732 is opposite to the first surface 731. As the second surface 732 extends in the removing direction R, the second surface 732 is inclined toward the body member 8. That is, as the first surface 731 and the second surface 732 extend toward the front, the first surface 731 and the second surface 732 become closer to the imaginary axis J. That is, the facing portion 73 has a tapered shape. In the illustrative embodiment, the first surface 731 and the second surface 732 extend substantially parallel to each other. The mark 733 is disposed on the center 70 of the facing portion 73 in the circumferential direction D. The mark 733 may be a protrusion extending in the front-rear direction. Each rib 734 is connected to the first surface 731 and a corresponding one of the protrusions 74 (741). Each rib 734 may have a plate-like shape. In the illustrative embodiment, for example, the retaining member 7 includes four ribs 734 substantially evenly spaced in the circumferential direction D. Each rib 734 has an inclined surface 735 that may face the body member 8. As with the first surface 731 and the second surface 732, as the inclined surface 735 extends in the removing direction R, the inclined surface 735 is inclined toward the body member 8.

Figure 10:
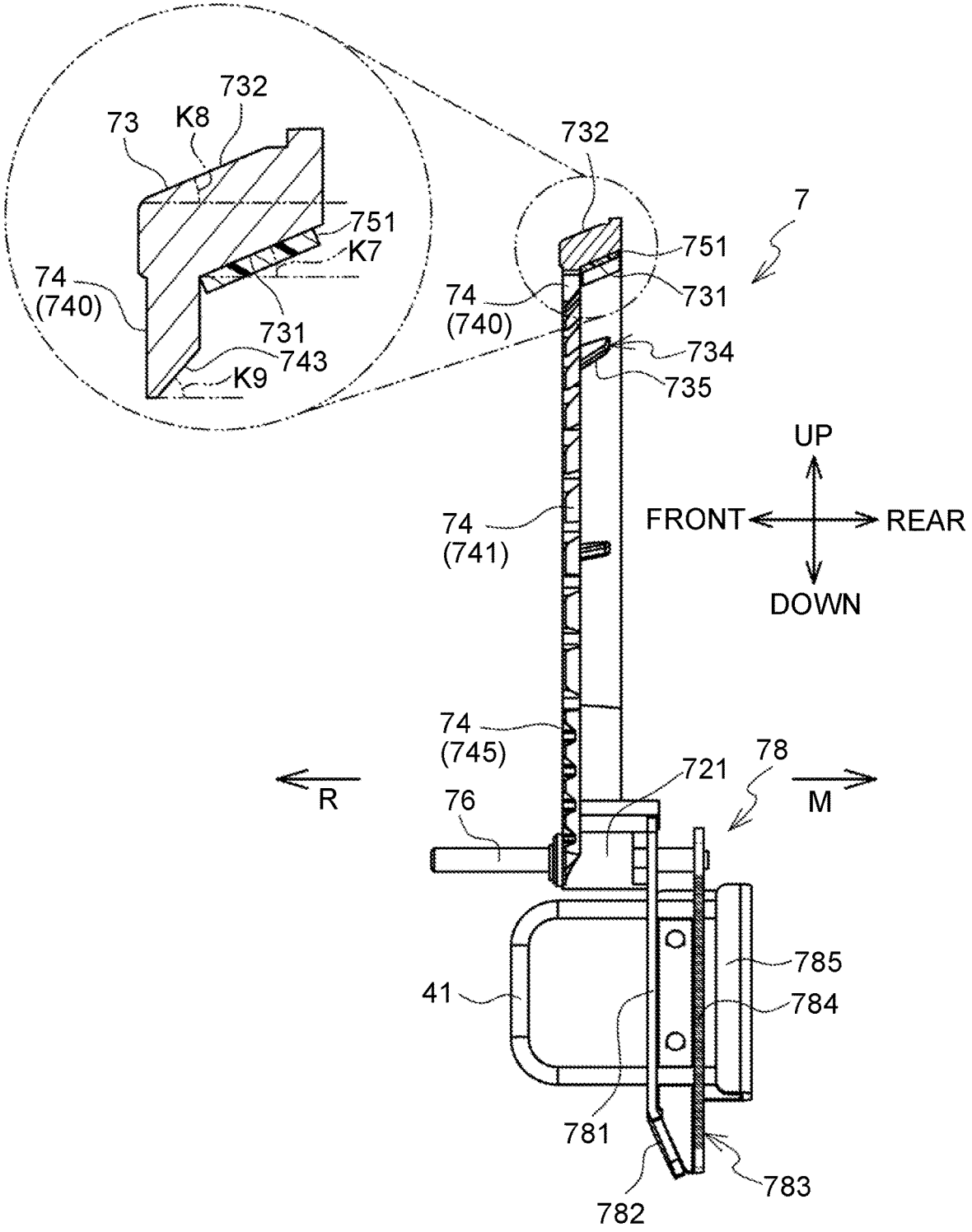
FIG. 10 illustrates a sectional view taken along line B-B of FIG. 9 as viewed in a direction of arrows and a partial enlarged sectional view of the retaining member including protrusions for explaining an angle of a first surface, an angle of a second surface, and an angle of an inclined surface each with respect to an imaginary axis according to the illustrative embodiment of the disclosure.
Figure 11:
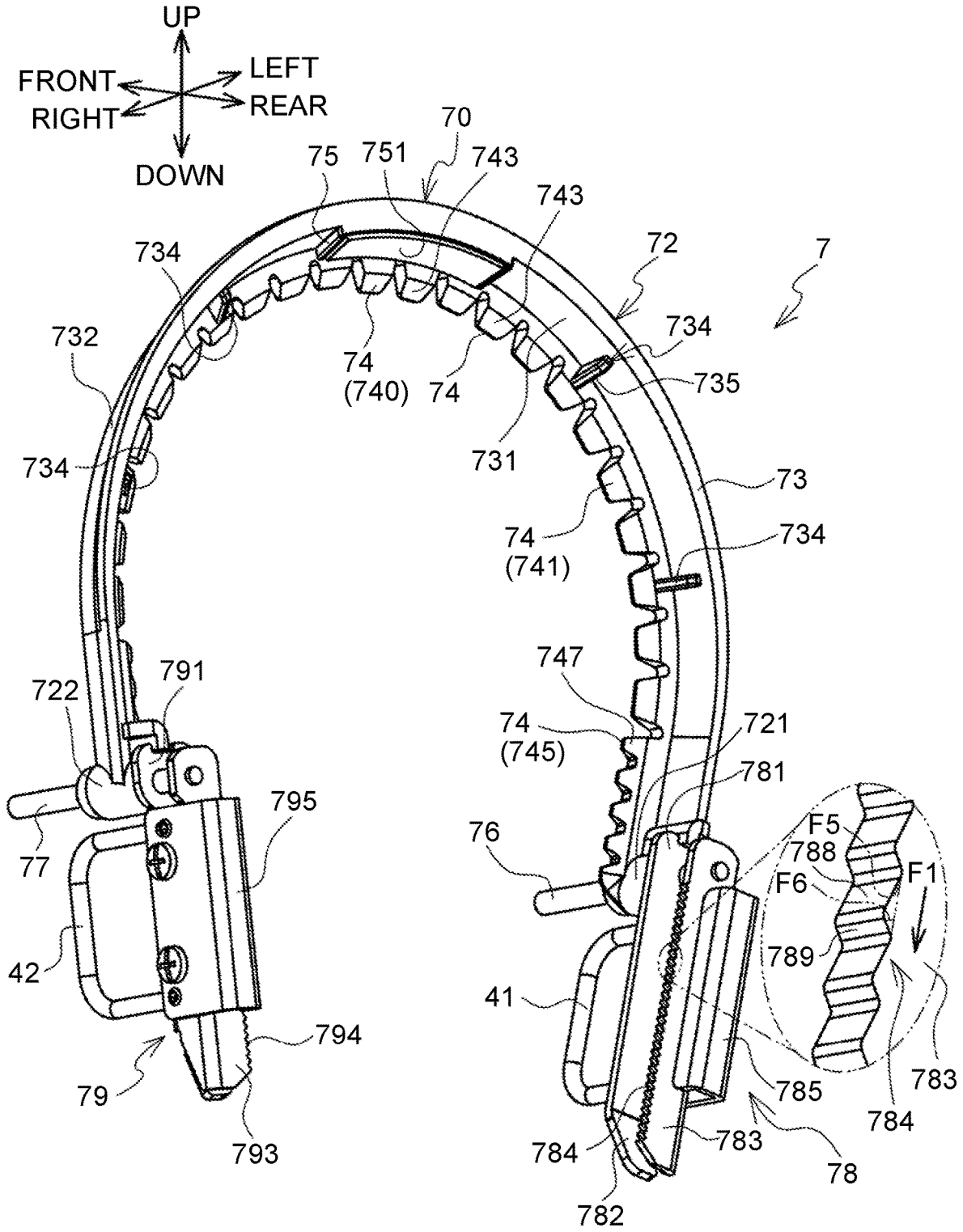
FIG. 11 is a rear perspective view of the retaining member in the illustrative embodiment according to one or more aspects of the disclosure.

In the illustrative embodiment, as illustrated in FIGS. 10 and 11, the facing portion 73 further includes a projecting portion 75 on the side thereof facing the body member 8. The projecting portion 75 protrudes toward the body member 8 from a particular area belonging to the facing portion 73 and including the center 70 in the circumferential direction D. The projecting portion 75 partially includes the first surface 731. As the first surface 731 at the projecting portion 75 extends in the removing direction R, the first surface 731 is inclined toward the body member 8. The facing portion 73 includes a cushioning 751 on the first surface 731 at the projecting portion 75. The cushioning 751 is provided for protection of a visor C2 of a cap C from damage. The cushioning 751 may be, for example, a sponge, a rubber sheet, or a resin sheet having a certain thickness. The cushioning 751 has a thickness (e.g., a dimension in the radial direction) less than a thickness (e.g., a dimension in the radial direction) of the facing portion 73.

The protrusions 74 protrude toward the curved wall 81 of the body member 8 from a front end of the first surface 731 of the facing portion 73. The protrusions 74 face the leading end of the curved wall 81 of the body member 8 in the removing direction R (e.g., the front end of the curved wall 81). The protrusions 74 are disposed at the second surface 732 of the facing portion 73 and aligned along the circumferential direction D. The leading end portion of the curved wall 81 in the removing direction R includes the front end of the curved wall 81 and is located further to the front than the center of the curved wall 81 in the front-rear direction. The situation where "the protrusions 74 face the leading end of the curved wall 81 in the removing direction R" includes a situation where the curved wall 81 is located further to the rear than the protrusions 74 and the protrusions 74 and the front end portion of the curved wall 81 face each other in the attaching direction M as well as a situation where the protrusions 74 and the front end portion of the curved wall 81 face each other in the radial direction of the curved wall 81. As illustrated in FIG. 9, the retaining member 7 has four equally defined sections R1, R2, R3, and R4 in the circumferential direction D. The retaining member 7 has the protrusions 74 at at least two sections R2 and R3 that are defined adjacent to the center 70 of the retaining member 7 in the circumferential direction D. The protrusions 74 includes two first protrusions 740, a plurality of second protrusions 741, and a plurality of third protrusions 745. Each first protrusion 740 is disposed adjacent to the center 70 of the retaining member 7 in the circumferential direction D. The third protrusions 745 are disposed at the end portions (e.g., the sections R1 and R4) of the retaining member 7 in the circumferential direction D. The second protrusions 741 are disposed between the pair of first protrusions 740 and the plurality of third protrusions 745 disposed at the section R1 and between the pair of first protrusions 740 and the plurality of third protrusions 745 disposed at the section R4 in the circumferential direction D.

The first protrusions 740 and the second protrusions 741 may have substantially the same shape. The second protrusions 741 may have a different shape from the third protrusions 745. As illustrated in FIG. 9, a protruding amount H2 of each third protrusion 745 is greater than a protruding amount H5 of each first protrusion 740 and a protruding amount H1 of each second protrusion 741. A distance H4 between a bottom of a valley 746 between adjacent third protrusions 745 and the facing portion 73 is greater than a distance H3 between a bottom of a valley 742 between adjacent second protrusions 741 and the facing portion 73. The adjacent second protrusions 741 may be any second protrusions 741 not included in the particular area of the facing portion 73 where the projecting portion 75 is provided. Each of the first protrusions 740 and the second protrusions 741 has an inclined surface 743 on its rear side (e.g., on a side thereof facing the body member 8). Each of the third protrusions 745 has an inclined surface 747 on its rear side (e.g., on a side thereof facing the body member 8). As the inclined surfaces 743 and 747 extend in the removing direction R, the inclined surfaces 743 and 747 are inclined toward the body member 8. An angle K9 of the inclined surface 743 and an angle of the inclined surface 747 with respect to an extending direction of the imaginary axis J (e.g., the front-rear direction) are greater than an angle K7 of the first surface 731 and an angle K8 of the second surface 732 with respect to the extending direction of the imaginary axis J. The angle K9 of the inclined surface 743 and the angle of the inclined surface 747 with respect to the extending direction of the imaginary axis J are substantially equal to an angle of the inclined surface 735 of the rib 734 with respect to the extending direction of the imaginary axis J. The support portions 721 and 722 each have a cylindrical shape. The support portion 721 extends toward the rear from the vicinity of a left end one of the plurality of protrusions 74 in the clamping portion 72. The support portion 722 extends toward the rear from the vicinity of a right end one of the plurality of protrusions 74 in the clamping portion 72.

Figure 12:
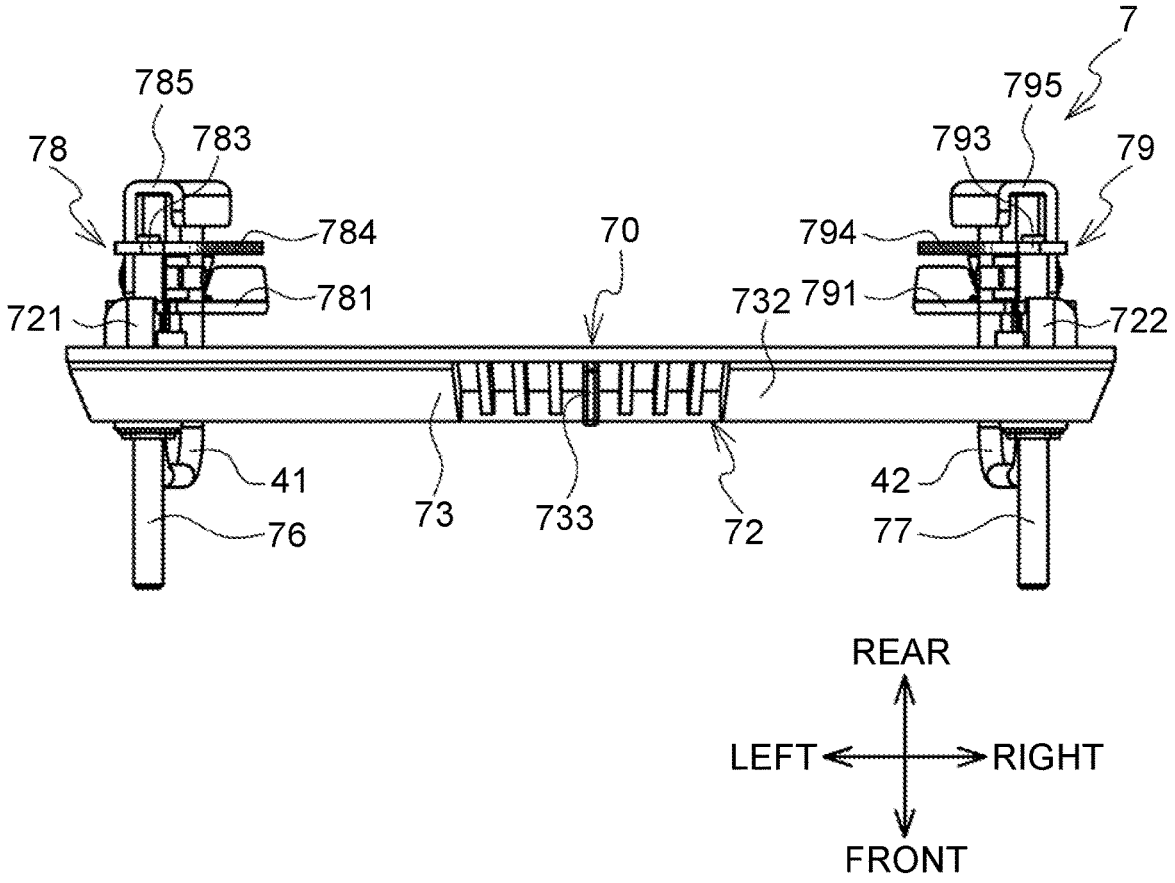
FIG. 12 is a top view of the retaining member in the illustrative embodiment according to one or more aspects of the disclosure.
Figure 13:
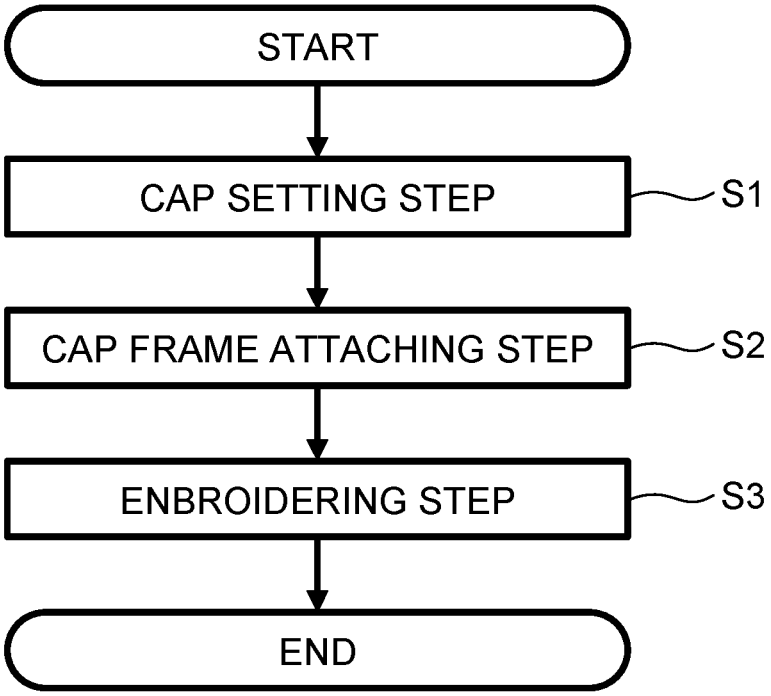
FIG. 13 is a flowchart of embroidering on a cap using the cap frame and the sewing machine in the illustrative embodiment according to one or more aspects of the disclosure.

As illustrated in FIGS. 9 to 12, the engagement portions 78 and 79 are disposed at the respective end portions of the clamping portion 72 in the circumferential direction D. More specifically, for example, the engagement portion 78 is disposed at the section R1 of the retaining member 7 in the circumferential direction D. The engagement portion 79 is disposed at the section R4 of the retaining member 7 in the circumferential direction D. The engagement portion 78 includes plate members 781, 783, and 785 extending in the up-down direction. The plate members 781, 783, and 785 may be made of metal (e.g., SPCC). As illustrated in FIG. 9, the plate member 781 includes a lower end portion 782 having a trapezoidal shape in front view. The lower end portion 782 has a right side that is inclined toward the left as the right side extends downward. As illustrated in FIG. 10, as the lower end portion 782 of the plate member 781 extends downward, the lower end portion 782 is inclined toward the rear. As illustrated in FIGS. 10 to 12, the plate member 783 is disposed behind the plate member 781. The plate member 783 has ratchet teeth 784 at its right end. Each of the ratchet teeth 784 is configured to restrict the movable direction of the engagement portion 78 to the guide direction F1. More specifically, for example, each of the ratchet teeth 784 has a surface 788 and a surface 789. An angle F5 of the surface 788 with respect to the guide direction F1 is smaller than an angle F6 of the surface 789 with respect to the guide direction F1. The surface 788 is longer than the surface 789 in the guide direction F1. The ratchet pawl 913 of the body member 8 is configured to engage one of the ratchet teeth 784 in accordance with the relative position of the retaining member 7 and the body member 8. In a case where an attempt is made to move the engagement portion 78 in the guide direction F1, the ratchet pawl 913 easily passes the ratchet tooth 784 that is in engagement with the ratchet pawl 913 and then comes into engagement with the next ratchet tooth 784. In a case where an attempt is made to move the engagement portion 78 in the direction opposite to the guide direction F1, the ratchet pawl 913 is jammed against the ratchet tooth 784 that is in engagement with the ratchet pawl 913 so as not to pass the ratchet tooth 784, thereby restricting the movement of the engagement portion 78 in the direction opposite to the guide direction F1. As illustrated in FIG. 12, when viewed from the top, the plate member 785 extends rearward beyond the plate member 783 from a left end of the plate member 781. The plate member 785 is bent toward the right behind the plate member 783 and further bent toward the front. The plate member 785 may thus have a hook-like shape.

As with the engagement portion 78, the engagement portion 79 includes plate members 791, 793, and 795. The plate member 793 has ratchet teeth 794 at its left end. As illustrated in FIG. 9, the plate member 791 includes a lower end portion 792 having a trapezoidal shape in front view. The lower end portion 792 has a left side that is inclined toward the right as the left side extends downward. In addition, as the lower end portion 792 extends downward, the lower end portion 792 is inclined toward the rear. The ratchet pawl 923 of the body member 8 is configured to engage one of the ratchet teeth 794 in accordance with the relative position of the retaining member 7 and the body member 8. The engagement portion 78 includes a handle 41 protruding frontward. The engagement portion 79 includes a handle 42 protruding frontward. In a state where the engagement portions 91 and 92 are engaged with the engagement portions 78 and 79, respectively, the handle 41 extends along the guide direction F1 and the handle 42 extends along the guide direction F2. The handles 41 and 42 enable the user to handle the retaining member 7 in attachment of the retaining member 7 to the body member 8. As illustrated in FIGS. 5A, 8A, and 8B, in a state where the retaining member 7 is attached to the body member 8 with the clamping portion 72 conforming to the curved wall 81, the distance between the engagement portions 78 and 79 in the width direction W decreases in the direction opposite to the convex direction P. For example, as illustrated in FIG. 5A, a distance L6 between a lower end portion of the handle 41 and a lower end portion of the handle 42 in the width direction W is shorter than a distance L5 between an upper end portion of the handle 41 and an upper end portion of the handle 42 in the width direction W.

The shafts 76 and 77 are disposed at the respective end portions of the clamping portion 72 and extend along the attaching direction M. The shafts 76 and 77 may be made of metal (e.g., SUM23 specified in JIS (Japanese Industrial standard): Free-cutting steels). As illustrated in FIG. 10, the shafts 76 and 77 each extend (e.g., toward the front) beyond the clamping portion 72 in the removing direction R. The engagement portions 78 and 79 are supported by the shafts 76 and 77 at respective positions further to the rear than the facing portion 73 so as to be pivotable relative to the clamping portion 72. More specifically, for example, the shaft 76 extends through holes of the plate members 781 and 783 of the engagement portion 78 and the cylindrical support portion 721. The shaft 77 extends through holes of the plate members 791 and 793 of the engagement portion 79 and the cylindrical support portion 722.

Figure 14A:
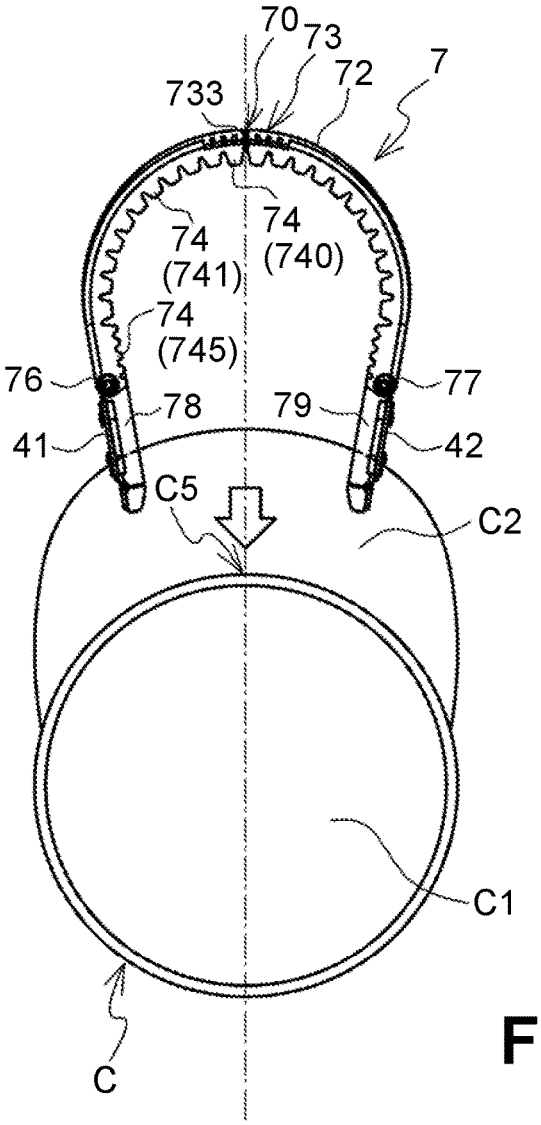
FIGS. 14A, 14B, and 14C are explanatory front views illustrating a procedure of attaching the cap to the cap frame in the illustrative embodiment according to one or more aspects of the disclosure.
Figure 14A:
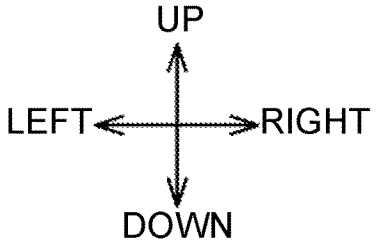
Figure 14B:
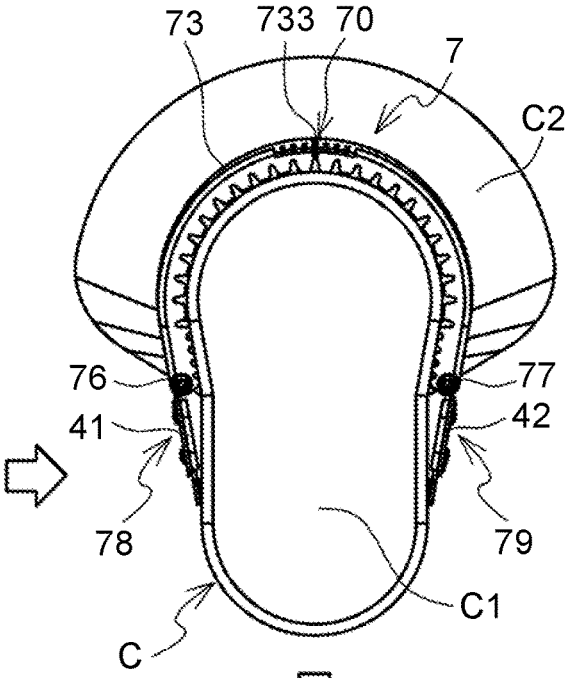

Referring to FIGS. 12, 13, 14A, 14B, and 14C, a description will be provided on a procedure for embroidering on a cap C including a crown C1 and a visor C2 using the cap frame 5 and the sewing machine 1 to which the cap frame 5 is attachable. For setting a cap C to the cap frame 5, a user contacts the protrusions 74 of the clamping portion 72 to a boundary C3 between a crown C1 and a visor C2 of a cap C while orienting the retaining member 7 such that the end having the protrusions 74 serves as the leading end of the facing portion 73 in the removing direction R, and places the cap C between the curved wall 81 of the body member 8 and the clamping portion 72 such that that the curved wall 81 contacts the visor C2. The user then presses the cap C toward the curved wall 81 to allow the cap frame 5 to hold the cap C (e.g., step S1). More specifically, for example, the user operates the operating portion 891 of the switch member 89 to position the engagement portions 91 and 92 at the respective engaged positions. If necessary, the user attaches an interfacing to the hooks 84 of the body member 8. As illustrated in FIGS. 14A and 15A, the user deforms the retaining member 7 by pulling the engagement portions 78 and 79 to the left and the right, respectively, while orienting the retaining member 7 such that the end having the protrusions 74 serves as the leading end of the facing portion 73 in the removing direction R. The user maintains such a state of the retaining member 7 and contacts the protrusions 74 to the boundary C3. At that time, the first protrusions 740 protruding greater than the second protrusions 741 from the facing portion 73 contact the boundary C3 on opposite sides of the center C5 of the boundary C3 in the right-left direction. Thus, the retaining member 7 is aligned with respect to the cap C in the circumferential direction D. The projecting portion 75 contacts the visor C2 around the center C5 of the boundary C3 via the cushioning 751. The user then contacts the second protrusions 741 and the third protrusions 745 to the boundary C3 of the cap C in the arrangement order from the center 70 of the retaining member 7 to the both end portions of the retaining member 7 in the circumferential direction D.

Figure 15A:
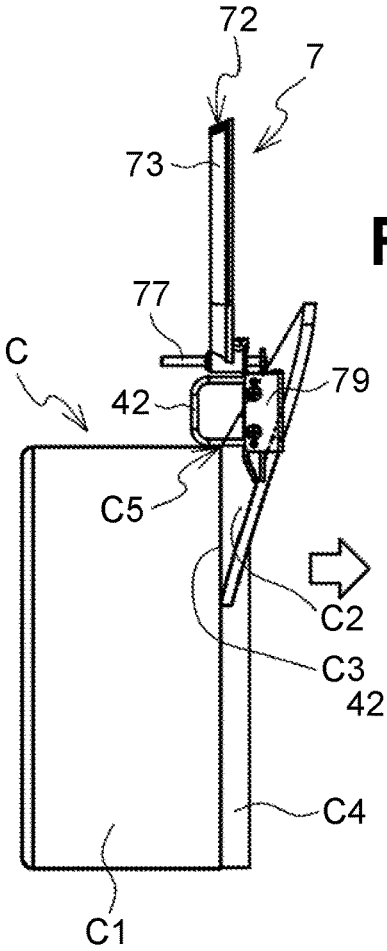
FIGS. 15A, 15B, and 15C are explanatory right side views illustrating the procedure of attaching the cap to the cap frame in the illustrative embodiment according to one or more aspects of the disclosure.
Figure 15A:
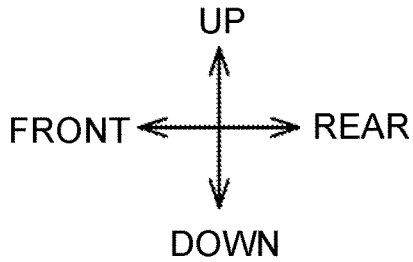
Figure 15B:
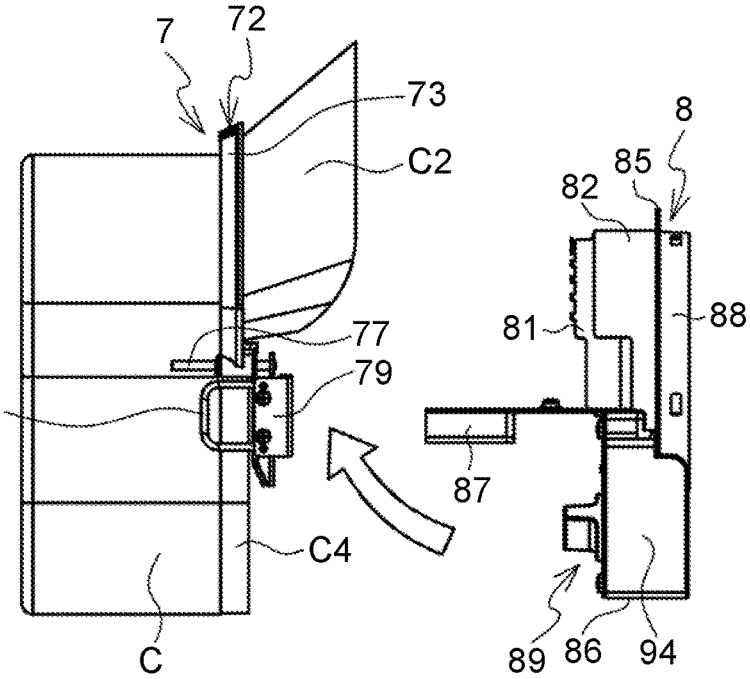

In a case where a cap C including a visor C2 and a crown C1 is for adults, a diameter of a circle in which an opening of the crown C1 is inscribed is approximately 18 cm in most cases, which is greater than 13 cm that may be the maximum distance L1 between the end portions of the curved wall 81 in the width direction W. In a case where the crown C1 of such a cap C is sandwiched by the retaining member 7 and the body member 8 of the cap frame 5 in the vicinity of the opening of the crown C1, as illustrated in FIGS. 14B and 15B, the crown C1 is held by the retaining member 7 and the body member 8 with being deformed into an oval shape conforming to the shape of the curved wall 81 of the body member 8. More specifically, for example, in the portion held by the retaining member 7 and the body member 8, the boundary C3 of the cap C is deformed to have a diameter smaller than the boundary C3 of the undeformed cap C. The crown C1 thus has an oval shape elongated in the up-down direction in front view. The user aligns the cap C with respect to the retaining member 7 in the circumferential direction D with reference to the mark 733.

Figure 5B:
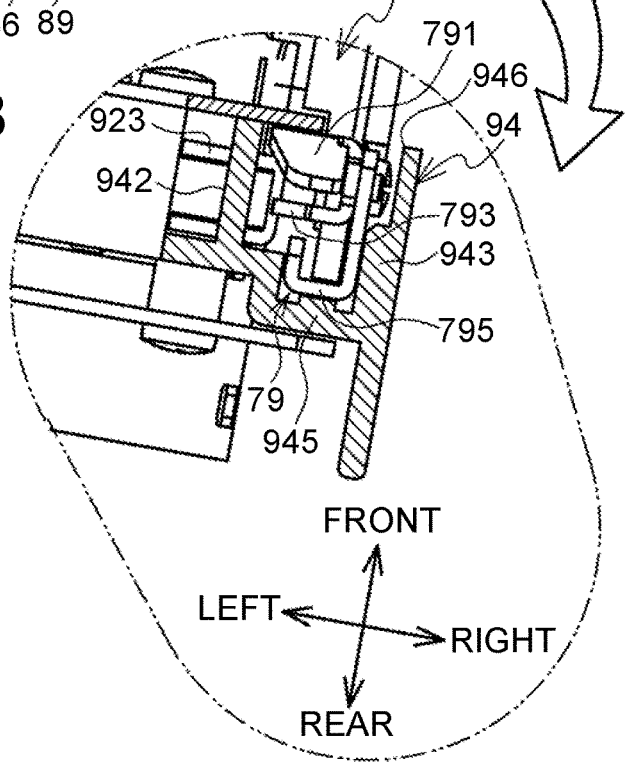
FIG. 5B is a partial sectional view taken along line A-A of FIG. 5A as viewed in a direction of arrows according to the illustrative embodiment of the disclosure.

While maintaining a sweatband C4 of the cap C lifted out from the inside of the cap C in the attaching direction M relative to the crown C1 and pulling the engagement portions 78 and 79 of the retaining member 7 to the left and the right, respectively, the user relatively moves the retaining member 7 toward the body member 8 to insert the engagement portions 78 and 79 of the retaining member 7 into the guide portions 93 and 94, respectively, of the body member 8. In response to this, the handle 41 and the handle 42 are inserted into the slit 936 of the guide portion 93 and the slit 946 of the guide portion 94, respectively, to protrude frontward relative to the casing 86. As illustrated in FIGS. 5A, 5B, and 8B, the engagement portion 79 contacts the walls 941, 942, and 943 of the guide portion 94 in the right-left direction and also contacts the plate member 861 and the wall 945 in the front-rear direction. Such a configuration may thus enable the guide portion 94 to restrict the movable direction of the engagement portion 79 to the guide direction F2 (e.g., a left downward direction) toward the engagement portion 92 and its opposite direction. As with the engagement portion 79, the engagement portion 78 contacts the walls 931, 932, and 933 of the guide portion 93 in the right-left direction and also contacts the plate member 861 and the wall 935 in the front-rear direction. Such a configuration may thus enable the guide portion 93 to restrict the movable direction of the engagement portion 78 to the guide direction F1 (e.g., a right downward direction) toward the engagement portion 91 and its opposite direction.

As the user moves the engagement portions 78 and 79 in the guide directions F1 and F2, respectively, relative to the body member 8 by holding the handles 41 and 42, the engagement portions 78 and 79 are guided to the engagement portions 91 and 92 by the guide portions 93 and 94, respectively. While the engagement portions 78 and 79 are guided by the guide portions 93 and 94, respectively, the engagement portions 78 and 79 each pivot in a direction to decrease the distance between the engagement portions 78 and 79 in the width direction W. More specifically, for example, while the engagement portion 78 is guided to the engagement portion 91 by the guide portion 93, the engagement portion 78 pivots counterclockwise on the shaft 76 when viewed from the front. While the engagement portion 79 is guided to the engagement portion 92 by the guide portion 94, the engagement portion 79 pivots clockwise on the shaft 77 when viewed from the front. Once the lowest one of the ratchet teeth 784 of the engagement portion 78 engages the ratchet pawl 913, the upward movement of the engagement portion 78 is restricted by the ratchet pawl 913 and the right-left movement and the front-rear movement of the engagement portion 78 are restricted by contact of the engagement portion 78 with the guide portion 93. Thus, in a state where the lowest one of the ratchet teeth 784 of the engagement portion 78 is in engagement with the ratchet pawl 913, the engagement portion 78 is allowed to move in the guide direction F1 only. Similarly, once the lowest one of the ratchet teeth 794 of the engagement portion 79 engages the ratchet pawl 923, the upward movement of the engagement portion 79 is restricted by the ratchet pawl 923 and the right-left movement and the front-rear movement of the engagement portion 79 are restricted by contact of the engagement portion 79 with the guide portion 94. Thus, in a state where the lowest one of the ratchet teeth 794 of the engagement portion 79 is in engagement with the ratchet pawl 923, the engagement portion 79 is allowed to move in the guide direction F2 only.

Figure 14C:
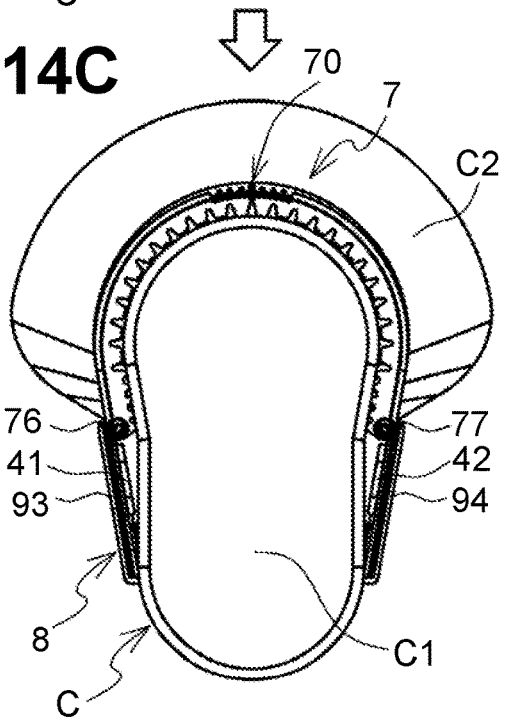
Figure 15C:
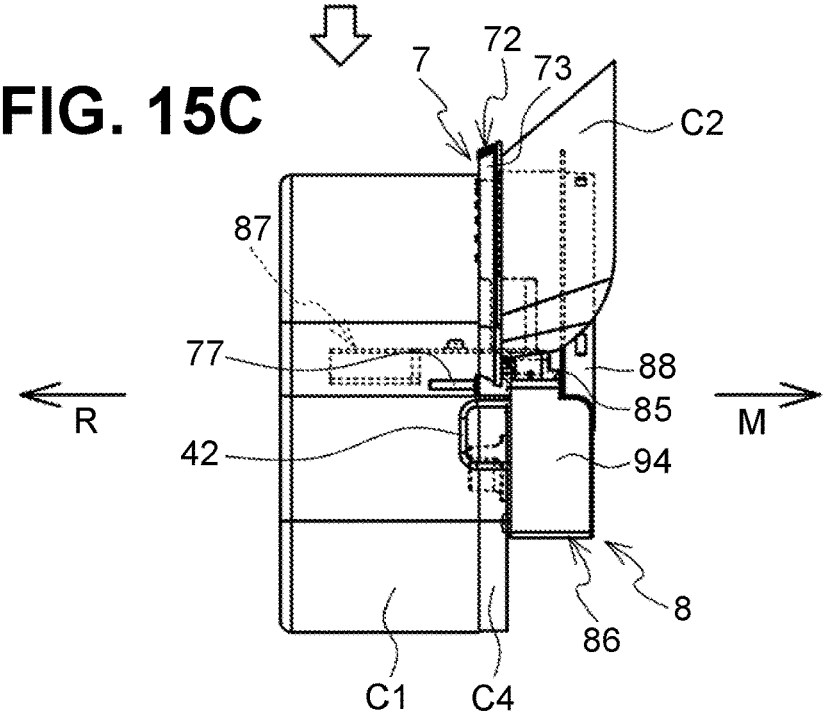
Figure 16:
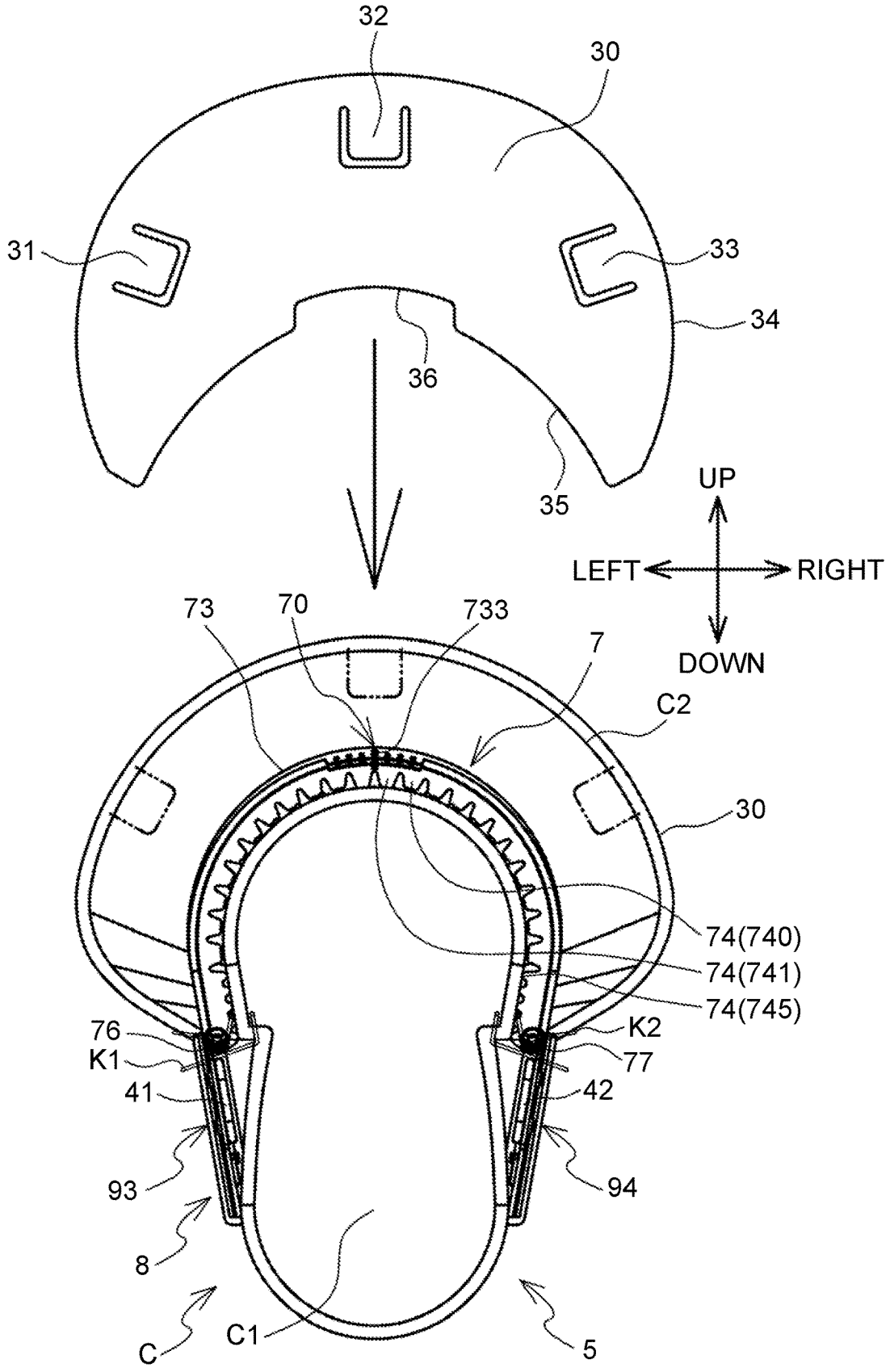
FIG. 16 is an explanatory front view illustrating a procedure of attaching a cover to the cap held by the cap frame in the illustrative embodiment according to one or more aspects of the disclosure.

As illustrated in FIGS. 14C and 15C, the user appropriately changes the ratchet tooth 784 engaging the ratchet pawl 913 from one to another and the ratchet tooth 794 engaging the ratchet pawl 923 from one to another to align the cap C with respect to the cap frame 5 in the circumferential direction D with reference to the marks 821 and 851 of the body member 8 and the mark 733 of the retaining member 7. For example, in a case where the center C5 of the boundary C3 of the cap C in the circumferential direction D and the center 70 of the retaining member 7 in the circumferential direction D are offset to the right from the center 80 of the curved wall 81 in the circumferential direction D, the user moves the engagement portion 78 relative to the engagement portion 91 in the guide direction F1 to align both of the center C5 and the center 70 with respect to the center 80 in the circumferential direction D. The user then confirms that the cap C is held taut in the circumferential direction D by the cap frame 5. Thereafter, as illustrated in FIG. 16, the user fastens the crown C1 to the attaching frame 87 by clipping particular portions of the crown C1, using the clips K1 and K2, in the vicinity of the shafts 76 and 77. In a state where the cap C is held by the cap frame 5, the hooks 84 of the body member 8 are in contact with the boundary C3 or the vicinity of the boundary C3 of the crown C1 from the side on which the imaginary axis J is provided. In a state where the cap C is held by the cap frame 5, the curved wall 81 of the body member 8 and the clamping portion 72 of the retaining member 7 sandwich the cap C therebetween. In such a state, only the hooks 84 disposed at the front end of the curved wall 81 are located on the crown C1 side with respect to the boundary C3 between the crown C1 and the visor C2. That is, in a state where the cap C is held by the cap frame 5, the other portion of the curved wall 81 of the body member 8 and the clamping portion 72 of the retaining member 7 are located on the boundary C3 or on the visor C2 side with respect to the boundary C3. In a state where the cap C is held by the cap frame 5, a distance between the boundary C3 and the plurality of hooks 84 in the front-rear direction may be from 0.2 mm to 3.0 mm approximately.

If necessary, the user attaches a cover 30 to the visor C2 of the cap C. The cover 30 may be removably attached to the visor C2 of the cap C for protection of the visor C2 from damage. The cover 30 may be, for example, a sector-shaped transparent member made of resin. The cover 30 has an arc-shaped inner peripheral edge 35 and an arc-shaped outer peripheral edge 34. The cover 30 has a recessed portion 36 in the inner peripheral edge 35. The recessed portion 36 is defined substantially at a middle of the inner peripheral edge 35 in a direction in which the inner peripheral edge 35 extends. The recessed portion 36 is recessed toward the outer peripheral edge 34. The cover 30 includes attaching portions 31, 32, and 33 in the vicinity of the outer peripheral edge 34. For attaching the cover 30 to the cap C, the user inserts, from the rear, the inner peripheral edge 35 of the cover 30 between the visor C2 and the facing portion 73 of the retaining member 7 such that the inner peripheral edge 35 of the cover 30 is positioned above the visor C2 and below the facing portion 73. At that time, the recessed portion 36 of the cover 30 is positioned in the vicinity of the projecting portion 75 of the facing portion 73. The user then engages the attaching portions 31, 32, and 33 with the edge of the visor C2 of the cap C to attach the cover 30 to the cap C.

The user attaches, to the sewing machine 1, the cap frame 5 holding the cap C (e.g., step S2). More specifically, for example, the user engages the engagement brackets 51, 52, and 53 of the frame unit 6 with the engagement portions 881, 882, and 883, respectively, of the cap frame 5 to couple the cap frame 5 holding the cap C to the rotary frame 63. The user then attaches the frame unit 6 to the holder 25 of the sewing machine 1 using the screws 68 and 69. As illustrated in FIG. 2, in a state where the cap frame 5 is attached to the sewing machine 1, the cylinder bed 10 of the sewing machine 1 extends through the frame unit 6, the cap frame 5 and the opening of the crown C1. An upper end of the crown C1 of the cap C held by the cap frame 5 extends substantially parallel to the cylinder bed 10. The visor C2 is positioned behind the needle bars 22. The visor C2 is out of contact with the sewing machine 1.

The user operates the button 14 and the operation interface 11 to start the sewing machine 1. In response to the user's operation, the sewing machine 1 embroiders a pattern on the crown C1 of the cap C with respect to the boundary C3 between the crown C1 and the visor C2 by moving the cap frame 5 attached to the sewing machine 1 in predetermined two directions based on embroidery data (e.g., step S3). Any suitable known method may be adopted for embroidering on a crown C1 of a cap C using the sewing machine 1. For example, in response to the sewing machine 1 detecting the attachment of the cap frame 5 thereto, the sewing machine 1 defines an embroidery area on the crown C1 side with respect to the boundary C3 (e.g., at a position further to the front than the boundary C3) in accordance with the type of the cap frame 5 based on data prestored in the sewing machine 1. The predetermined two directions may be directions in which the moving mechanism 20 of the sewing machine 1 moves the holder 25. The predetermined two directions may be, for example, the right-left direction and the front-rear direction. As illustrated in FIG. 2, in the cap frame 5, the facing portion 73 has the inclined second surface 732. Such a configuration may thus prevent the parts of the sewing machine 1 such as a needle bar 22 and a presser foot 24 from interfering with the cap frame 5 in a case where the sewing machine 1 embroiders a pattern on the crown C1 in the vicinity of the boundary C3. The cap frame 5 holds the cap C with the clamping portion 72 pressing, toward the curved wall 81, the cap C placed between the curved wall 81 and the clamping portion 72. More specifically, for example, in such a state, the protrusions 74 of the clamping portion 72 are in contact with the boundary C3 between the crown C1 and the visor C2 of the cap C while the retaining member 7 is oriented such that the end having the protrusions 74 serves as the leading end of the facing portion 73 in the removing direction R. The curved wall 81 is in contact with the visor C2. As illustrated in FIGS. 1 and 2, in a state where the cap frame 5 holding the cap C is attached to the sewing machine 1, the cap frame 5 may be positioned such that a distance from the boundary C3 to a particular position on the needle plate 16 may be shortened as compared with the known cap frame. The particular position may correspond to the position at which the needle bars 22 are aligned. Thus, the cap frame 5 may enable the sewing machine 1 to define an embroidery area whose range may be extended in the attaching direction M as compared with an embroidery area defined using the known cap frame. The embroidery area may be defined as an area in which the sewing machine 1 can embroider a pattern on a crown C1 of a cap C held by the cap frame 5. In the illustrative embodiment, in a state where the cap C is held by the cap frame 5, the curved wall 81 of the body member 8 and the clamping portion 72 of the retaining member 7 sandwich the cap C therebetween. In such a state, the hooks 84 disposed at the front end of the curved wall 81 are located on the crown C1 side with respect to the boundary C3 between the crown C1 and the visor C2. A distance between the boundary C3 and the plurality of hooks 84 in the front-rear direction may be approximately a few millimeters. The hooks 84 are in contact with the cap C from the imaginary axis J side. Thus, consideration might not be required to collision of one or more of the hooks 84 to a member or a component disposed above the needle plate 16 such as a presser foot 24 of the sewing machine 1. Consequently, in the cap frame 5 of the illustrative embodiment, of the curved wall 81 of the body member 8 and the clamping portion 72 of the retaining member 7 that hold the cap C therebetween, a limit of the range of the embroidery area in the attaching direction M may be specified based on the position of the clamping portion 72. After the sewing machine 1 completes embroidering on the cap C, the user removes the frame unit 6 from the sewing machine 1. The user then operates the operating portion 891 of the switch member 89 to release the engagement between the engagement portions 78 and 91 and the engagement between the engagement portions 79 and 92 and removes the cap C from the cap frame 5. Through the above-described steps, the crown C1 of the cap C is embroidered with a pattern using the cap frame 5 and the sewing machine 1 to which the cap frame 5 is attachable.

According to the cap frame 5 of the illustrative embodiment, engaging the engagement portions 78 and 79 of the retaining member 7 to the engagement portions 91 and 92, respectively, of the body member 8 may enable the retaining member 7 to be attached to the body member 8 with the retaining member 7 conforming to the shape of the curved wall 81. Such an attaching manner may thus enable the alignment of a cap C with respect to the cap frame 5 with a simpler procedure as compared with the known procedure in which a retaining member is attached to a body member with a one end portion of the retaining member fixed to the body member.

In the cap frame 5, the engagement portion 91 is configured to engage the engagement portion 78 at one of the plurality of engagement positions. The engagement portion 92 is configured to engage the engagement portion 79 at one of the plurality of engagement positions. Thus, the retaining member 7 and the body member 8 are allowed to be located at one of the plurality of relative positions. Such a configuration may thus enable adjustment of the engagement position between the engagement portion 91 and the engagement portion 78 and the engagement position between the engagement portion 92 and the engagement portion 79 in accordance with the size and thickness of a cap C held by the cap frame 5. According to the cap frame 5, the user may be allowed to adjust the engagement position between the engagement portion 91 and the engagement portion 78 and the engagement position between the engagement portion 92 and the engagement portion 79 individually in accordance with the size and thickness of a cap C held by the cap frame 5. Such a configuration may thus enable the user to align the cap C to a desired position with respect to the cap frame 5 more readily as compared with a case where the engagement portion 91 is engaged with the engagement portion 78 at a single engagement position and the engagement portion 92 is engaged with the engagement portion 79 at a single engagement position.

The engagement portion 78 has the ratchet teeth 784 and the engagement portion 79 has the ratchet teeth 794. The engagement portion 91 includes the ratchet pawl 913 configured to engage one of the ratchet teeth 784. The engagement portion 92 includes the ratchet pawl 923 configured to engage one of the ratchet teeth 794. Such a configuration may thus enable adjustment of the engagement position between the engagement portion 78 and the engagement portion 91 and the engagement position between the engagement portion 79 and the engagement portion 92 in accordance with the size and thickness of a cap C held by the cap frame 5 by changing the ratchet tooth 784 engaging the ratchet pawl 913 from one to another and the ratchet tooth 794 engaging the ratchet pawl 923 from one to another. According to the cap frame 5, the user may be allowed to adjust stepwise the engagement position between the engagement portion 78 and the engagement portion 91 and the engagement position between the engagement portion 79 and the engagement portion 92 individually in accordance with the size and thickness of a cap C held by the cap frame 5 with a relatively simple manner of moving the engagement portions 78 and 79 in the guide directions F1 and F2, respectively.

The cap frame 5 includes the switch member 89 configured to change the respective positions of the engagement portions 91 and 92 between the engaged position and the disengaged position. At the engaged position, the engagement portions 91 and 92 are capable of engaging the engagement portions 78 and 79, respectively. At the disengaged position, the engagement portions 91 and 92 are incapable of engaging the engagement portions 78 and 79, respectively. According to the cap frame 5, the user is allowed to change the respective positions of the engagement portions 91 and 92 between the engaged position and the disengaged position simultaneously by a single operation of the switch member 89. The cap frame 5 may thus enable the user to change the respective positions of the engagement portions 91 and 92 between the engaged position and the disengaged position more readily as compared with a case where the cap frame 5 has a configuration that may require the user to change the respective positions of the engagement portions 91 and 92 between the engaged position and the disengaged position individually.

In the cap frame 5, the guide portion 93 includes the walls 931, 932, and 933 extending along the guide direction F1. The guide portion 94 includes the walls 941, 942, and 943 extending along the guide direction F2. The guide portion 93 is configured to guide the engagement portions 78 of the retaining member 7 to the engagement portion 91 of the body member 8 with a relatively simple configuration. The guide portion 94 is configured to guide the engagement portion 79 of the retaining member 7 to the engagement portion 92 of the body member 8 with a relatively simple configuration. While the guide portion 93 contacts the engagement portion 78 from all sides around the guide direction F1, the guide portion 93 allows the handle 41 of the engagement portion 78 to protrude frontward through the slit 936 of the guide portion 93, thereby enabling the user to hold and operate the handle 41. As with the guide portion 93, while the guide portion 94 contacts the engagement portion 79 from all sides around the guide direction F2, the guide portion 94 allows the handle 42 of the engagement portion 79 to protrude frontward through the slit 946 of the guide portion 94, thereby enabling the user to hold and operate the handle 42. Thus, the cap frame 5 may define the movable directions of the engagement portions 78 and 79 to as the guide directions F1 and F2, respectively, without loss of handleability of the retaining member 7 during attachment of the retaining member 7 to the body member 8.

In the cap frame 5, the distance between the guide portions 93 and 94 in the width direction W (e.g., the right-left direction) decreases as the guide portions 93 and 94 extend in the direction (e.g., the downward direction) opposite to the convex direction P (e.g., the upward direction). In the cap frame 5, thus, the end portions of the clamping portion 72 in the circumferential direction D may be pressed toward the body member 8 more strongly as compared with a case where the distance between the guide portions 93 and 94 in the width direction W increases as the guide portions 93 and 94 extend in the direction opposite to the convex direction P. Consequently, the configuration according to the illustrative embodiment may reduce variations, in the circumferential direction D, in pressure applied by the retaining member 7 to a cap C held between the retaining member 7 and the body member 8 in a state where the retaining member 7 is attached to the body member 8 with the retaining member 7 conforming to the curved wall 81.

In a state where the retaining member 7 is attached to the body member 8 with the clamping portion 72 conforming to the curved wall 81, the distance between the engagement portions 78 and 79 in the width direction W decreases in the direction opposite to the convex direction P. In the cap frame 5, thus, the end portions of the clamping portion 72 in the circumferential direction D may be press toward the body member 8 more strongly as compared with a case where the distance between the engagement portions 78 and 79 in the width direction W increases as the engagement portions 78 and 79 extend in the direction opposite to the convex direction P. Consequently, the configuration according to the illustrative embodiment may reduce variations, in the circumferential direction D, in pressure applied by the retaining member 7 to a cap C held between the retaining member 7 and the body member 8 in a state where the retaining member 7 is attached to the body member 8 with the retaining member 7 conforming to the curved wall 81.

The retaining member 7 includes the shafts 76 and 77 extending along the attaching direction M at the respective end portions of the clamping portion 72. The engagement portions 78 and 79 are pivotably supported by the shafts 76 and 77, respectively. While the engagement portions 78 and 79 are guided to the engagement portions 91 and 92 by the guide portions 93 and 94, respectively, the engagement portions 78 and 79 each pivot in the direction to decrease the distance between the engagement portions 78 and 79 in the width direction W. Such a configuration may thus enable the engagement portions 78 and 79 to change their postures in accordance with the respective shapes of the guide portions 93 and 94 even when the engagement portions 78 and 79 are made of nonelastic material. In the cap frame 5, during attachment of the retaining member 7 to the body member 8, the engagement portions 78 and 79 pivot on the respective shafts 76 and 77. Thus, the distance between the engagement portions 78 and 79 in the width direction W may decrease as the engagement portions 78 and 79 extend in the direction opposite to the convex direction P, thereby enabling the end portions of the clamping portion 72 in the circumferential direction D to be pressed toward the body member 8. Consequently, such a configuration may thus reduce variations, in the circumferential direction D, in pressure applied by the retaining member 7 to a cap C held between the retaining member 7 and the body member 8 in a state where the retaining member 7 is attached to the body member 8 with the retaining member 7 conforming to the curved wall 81.

The shafts 76 and 77 each extend beyond the clamping portion 72 in the direction from the one side of the cap frame 5, in which the attaching portion 88 of the body member 8 may be provided, to the other side of the cap frame 5, in which the curved wall 81 of the body member 8 may be provided (e.g., the removing direction R). In the cap frame 5, such a configuration may thus enable the retaining member 7 to maintain the shape of a boundary C3 between a crown C1 and a visor C2 of a cap C deformed in conformance with the curved wall 81 in sandwiching of the cap C in cooperation with the body member 8.

The maximum distance L1 between the end portions of the curved wall 81 in the width direction W may be 13 cm or less. The cap frame 5 may thus be smaller in size than the known cap frame. In a case where a crown C1 of a cap C for adults is sandwiched by the retaining member 7 and the body member 8 of the cap frame 5 in the vicinity of an opening of the crown C1, the crown C1 is held by the retaining member 7 and the body member 8 while being deformed into an oval shape conforming to the shape of the curved wall 81 of the body member 8. In response to the crown C1 being deformed into such a shape, a visor C2 of the cap C is deformed correspondingly. At that time, the visor C2 moves toward the imaginary axis J relative to the crown C1 so as to be closer to the imaginary axis J than the undeformed visor C2 is to the imaginary axis J. In the cap C attached to the cap frame 5, an angle C8 (refer to FIG. 2) of the visor C2 with respect to the crown C1 is greater than the angle C8 in the cap C that is not attached to the cap frame 5. The angle C8 of the visor C2 with respect to the crown C1 may be an angle measure of an angle formed by a periphery of the crown C1 and the visor C2. Consequently, in a case where the cap frame 5 holding the cap C is attached to the sewing machine 1, the cap frame 5 may reduce possibility of occurrence of contact of the visor C2 of the cap C with the sewing machine 1.

The clamping portion 72 includes the protrusions 74 protruding toward the curved wall 81 in a state where the retaining member 7 is attached to the body member 8. In a state where the retaining member 7 is attached to the body member 8, the protrusions 74 are aligned along the circumferential direction D. The third protrusions 745 that are disposed at the end portions of the clamping portion 72 protrude toward the body member 8 more than the first protrusions 740 and the second protrusions 741 that are disposed closer to the center 70 of the clamping portion 72 in the circumferential direction D than the third protrusions 745 are to the center 70. Such a configuration may thus enable the cap frame 5 to securely hold, by the third protrusions 745, a boundary C3 of a cap C at end portions of a visor C2 in the circumferential direction D. The curved wall 81 according to the illustrative embodiment has the recessed portions 811 and 812 at the respective positions to face the corresponding third protrusions 745. Such a configuration may thus enable the third protrusions 745 to press a boundary C3 of a cap C to position end portions of the boundary C3 in the circumferential direction D closer to the imaginary axis J than the curved wall 81 is to the imaginary axis J. In such a state, the third protrusions 745 face the front end of the curved wall 81 in the front-rear direction. In some case, a cap C attached to the cap frame 5 may have a seam between panels of a crown C1 in the vicinity of the center C5 of a boundary C3 in the circumferential direction D. In such a case, the center C5 and its surrounding portion of the boundary C3 may be thicker than the other portion of the boundary C3. In the illustrative embodiment, the curved wall 81 has the recessed portion 83 defined in its particular portion that includes the center 80 of the curved wall 81 in the circumferential direction D. Such a configuration may thus enable the first protrusions 740 to press the center C5 and its surrounding portion of the boundary C3 to position the center C5 of the boundary C3 closer to the imaginary axis J than the curved wall 81 is to the imaginary axis J. In such a state, the first protrusions 740 face the front end of the curved wall 81 in the front-rear direction. Consequently, in the cap frame 5, such a configuration may reduce uneven application of pressure to the body member 8 by the retaining member 7 caused by uneven thickness of a boundary C3 of a cap C.

While the disclosure has been described in detail with reference to the specific embodiment thereof, this is merely an example, and various changes, arrangements and modifications may be made therein without departing from the spirit and scope of the disclosure. The cap frame 5 may have another suitable configuration. Each component of the cap frame 5 may be made of another suitable material. The sewing machine 1 to which the cap frame 5 is attachable may have another suitable configuration. The cap frame 5 may be in one piece with and inseparable from the frame unit 6. The attaching portion 88 that enables the cap frame 5 to be attached to the frame unit 6 may have another suitable configuration. The cap frame 5 might not necessarily have a substantially mirror-symmetrical structure with respect to the plane E. The retaining member 7 of the cap frame 5 may have a similar configuration to the known cap frame. More specifically, for example, the retaining member 7 may have protrusions and an opening through which a visor C2 of a cap C may pass. In a state where the retaining member 7 is oriented such that an end having the protrusions serves as a leading end of a facing portion in the attaching direction M, the retaining member 7 may press a cap C with the protrusions contacting a boundary C3 between a crown C1 and a visor C2 of the cap C.

The engagement portion 91 might not necessarily be configured to engage the engagement portion 78 at one of the plurality of engagement positions. The engagement portion 92 might not necessarily be configured to engage the engagement portion 79 at one of the plurality of engagement positions. At least either one of the engagement portions 78 and 79 might not necessarily have a plurality of ratchet teeth. In other embodiments, for example, at least one of the engagement portions 78 and 79 may have a single ratchet tooth. At least either one of the engagement portions 91 and 92 might not necessarily include a ratchet pawl that may engage one of corresponding ratchet teeth. In other embodiments, for example, at least one of the engagement portions 91 and 92 may include a ratchet pawl that may engage a single ratchet tooth. The engagement portions 78 and 79 and the engagement portions 91 and 92 may each have another configuration as long as the engagement portions 78 and 79 and the engagement portions 91 and 92 may allow the retaining member 7 to be removably attachable to the body member 8. For example, the engagement portions 78 and 79 and the engagement portions 91 and 92 may be toggle latches.

The cap frame 5 might not necessarily include the switch member 89. In another example, the switch member 89 may be configured to change the respective positions of the engagement portions 91 and 92 between the engaged position and the disengaged position individually. In still another example, the switch member 89 may be configured to change the respective positions of the engagement portions 91 and 92 between the engaged position and the disengaged position in response to whether a user presses a button. The cap frame 5 might not necessarily include the guide portions 93 and 94. The guide portions 93 and 94 may each have another suitable configuration. For example, at least one of the guide portions 93 and 94 may be a rail configured to engage the plate portion of a corresponding one of the engagement portions 78 and 79.

The curved wall 81 of the body member 8 of the cap frame 5 might not necessarily include all of the recessed portions 83, 811, and 812. In the body member 8, the curved walls 81 and 82 may be in one piece with and inseparable from each other. The body member 8 might not necessarily include the flange 85. The curved wall 81 might not necessarily include the hooks 84 at its leading end in the removing direction R. The shape, arrangement, and number of the hooks 84 may be modified appropriately. The distance between the guide portions 93 and 94 in the width direction W may be constant at any position in the convex direction P. In another example, the distance between the guide portions 93 and 94 in the width direction W may increase as the guide portions 93 and 94 extend in the direction (e.g., the downward direction) opposite to the convex direction P (e.g., the upward direction). In a state where the retaining member 7 is attached to the body member 8 with the clamping portion 72 conforming to the curved wall 81, the distance between the engagement portions 78 and 79 in the width direction W may be constant at any position in the convex direction P. In another example, the distance between the engagement portions 78 and 79 in the width direction W may increase as the engagement portions 78 and 79 extend in the direction (e.g., the downward direction) opposite to the convex direction P (e.g., the upward direction). The retaining member 7 might not necessarily include the shafts 76 and 77 extending along the attaching direction M at the respective end portions of the clamping portion 72. In such a case, for example, the engagement portions 78 and 79 may be made of the same material used for the clamping portion 72 and may be in one piece with and inseparable from the clamping portion 72. In another example, the engagement portions 78 and 79 may be made of different material from the material used for the clamping portion 72 and may be connected to the clamping portion 72 so as not to be pivotable. The shafts 76 and 77 each might not necessarily extend beyond the clamping portion 72 in the removing direction R.

The maximum distance L1 between the end portions of the curved wall 81 in the width direction W may be greater than 13 cm. The clamping portion 72 might not necessarily include the protrusions 74. The shape, arrangement, and number of the protrusions 74 may be modified appropriately. In one example, the protrusions 74 may protrude toward the imaginary axis J from a leading end of the facing portion 73 in the attaching direction M. All of the protrusions 74 may protrude from the facing portion 73 by the same amount regardless of the positions in the circumferential direction D. The retaining member 7 may have the protrusions 74 at a portion of each of the sections R2 and R3 defined adjacent to the center 70 of the retaining member 7 in the circumferential direction D.

What is claimed is:

1. A cap frame comprising:

a body member including a curved wall, the curved wall having an arc shape and extending in a particular direction;

a retaining member configured to, in a state where the retaining member is attached to the body member, hold a cap in cooperation with the body member to sandwich the cap therebetween, the retaining member including:

a clamping portion made of elastic material, the clamping portion configured to, in the state where the retaining member is attached to the body member, be elastically deformed in conformance with the curved wall and press, toward the curved wall, the cap sandwiched between the curved wall and the clamping portion; and a first engagement portion and a second engagement portion disposed at end portions of the clamping portion in the particular direction in the state where the retaining member is attached to the body member; and an attaching portion disposed at at least one of the body member and the retaining member, the attaching portion configured to be removably attached to a moving mechanism of an embroidery machine, wherein the body member further includes:

a third engagement portion and a fourth engagement portion configured to:

engage the first engagement portion and the second engagement portion, respectively, of the retaining member;

in a case where the third engagement portion and the fourth engagement portion are in engagement with the first engagement portion and the second engagement portion, respectively, of the retaining member with the clamping portion conforming to the curved wall, restrict the retaining member and the body member from moving relative to each other, thereby fastening the retaining member to the body member in conformance with the body member; and in a case where the third engagement portion and the fourth engagement portion are out of engagement with the first engagement portion and the second engagement portion, respectively, of the retaining member, allow the retaining member and the body member to move relative to each other;

a first guide portion defining a movable direction of the first engagement portion as a first guide direction toward the third engagement portion and a direction opposite to the first guide direction; and a second guide portion defining a movable direction of the second engagement portion as a second guide direction toward the fourth engagement portion and a direction opposite to the second guide direction, wherein the first engagement portion is guided by the first guide portion in a tangent direction of the arc shape of the body member and the second engagement portion is guided by the second guide portion in the tangent direction, wherein a distance between the first guide portion and the second guide portion in a width direction decreases in a direction opposite to a convex direction of the curved wall, wherein the width direction is perpendicular to both an attaching direction and the convex direction, and the attaching direction is directed from one side of the cap frame, in which the curved wall is provided, toward the other side of the cap frame, in which the attaching portion is provided, wherein the retaining member further includes a first shaft and a second shaft at the respective end portions of the clamping portion, wherein the first shaft and the second shaft extend along the attaching direction, and wherein the first engagement portion and the second engagement portion are pivotably supported by the first shaft and the second shaft, respectively, and the first engagement portion and the second engagement portion are configured to, while the first engagement portion and the second engagement portion are guided to the third engagement portion and the fourth engagement portion by the first guide portion and the second guide portion, respectively, pivot in respective directions to decrease the distance between the first engagement portion and the second engagement portion in the width direction.

2. The cap frame according to claim 1, wherein the third engagement portion is configured to engage the first engagement portion at one of a plurality of engagement positions and the fourth engagement portion is configured to engage the second engagement portion at one of a plurality of engagement positions, thereby allowing the retaining member and the body member to be located at one of a plurality of relative positions.

3. The cap frame according to claim 1, wherein the first guide portion includes a first wall extending in the first guide direction, and wherein the second guide portion includes a second wall extending in the second guide direction.

4. The cap frame according to claim 1, wherein in the state where the retaining member is attached to the body member with the clamping portion conforming to the curved wall of the body member, a distance between the first engagement portion and the second engagement portion in the width direction decreases in the direction opposite to the convex direction.

5. The cap frame according to claim 1, wherein the first shaft and the second shaft each extend beyond the clamping portion in a direction directed from the other side of the cap frame toward the one side of the cap frame.

6. The cap frame according to claim 1, wherein a maximum distance between end portions of the curved wall in a width direction is 13 cm or less, wherein the width direction is perpendicular to both an attaching direction and a convex direction of the curved wall, and the attaching portion is directed from one side of the cap frame, in which the curved wall is provided, toward the other side of the cap frame, in which the attaching portion is provided.

7. The cap frame according to claim 1, wherein the clamping portion further includes a plurality of protrusions, wherein in the state where the retaining member is attached to the body member, each of the plurality of protrusions extends toward the curved wall, wherein the plurality of protrusions are aligned along the particular direction, and wherein one or more of the plurality of protrusions that are disposed at the end portions of the clamping portion protrude toward the body member more than the remainder of the plurality of protrusions that are disposed closer to the center of the clamping portion.

8. A cap frame comprising:

a body member including a curved wall, the curved wall having an arc shape and extending in a particular direction;

a retaining member configured to, in a state where the retaining member is attached to the body member, hold a cap in cooperation with the body member to sandwich the cap therebetween, the retaining member including:

a clamping portion made of elastic material, the clamping portion configured to, in the state where the retaining member is attached to the body member, be elastically deformed in conformance with the curved wall and press, toward the curved wall, the cap sandwiched between the curved wall and the clamping portion; and a first engagement portion and a second engagement portion disposed at end portions of the clamping portion in the particular direction in the state where the retaining member is attached to the body member; and an attaching portion disposed at at least one of the body member and the retaining member, the attaching portion configured to be removably attached to a moving mechanism of an embroidery machine, wherein the body member further includes:

a third engagement portion and a fourth engagement portion configured to:

engage the first engagement portion and the second engagement portion, respectively, of the retaining member;

in a case where the third engagement portion and the fourth engagement portion are in engagement with the first engagement portion and the second engagement portion, respectively, of the retaining member with the clamping portion conforming to the curved wall, restrict the retaining member and the body member from moving relative to each other, thereby fastening the retaining member to the body member in conformance with the body member; and in a case where the third engagement portion and the fourth engagement portion are out of engagement with the first engagement portion and the second engagement portion, respectively, of the retaining member, allow the retaining member and the body member to move relative to each other;

a first guide portion defining a movable direction of the first engagement portion as a first guide direction toward the third engagement portion and a direction opposite to the first guide direction; and a second guide portion defining a movable direction of the second engagement portion as a second guide direction toward the fourth engagement portion and a direction opposite to the second guide direction, wherein the third engagement portion is configured to engage the first engagement portion at one of a plurality of engagement positions and the fourth engagement portion is configured to engage the second engagement portion at one of a plurality of engagement positions, thereby allowing the retaining member and the body member to be located at one of a plurality of relative positions, wherein each of the first engagement portion and the second engagement portion includes a plurality of ratchet teeth, and wherein each of the third engagement portion and the fourth engagement portion includes a ratchet pawl configured to engage one of the plurality of rachet teeth of a corresponding one of the third engagement portion and the fourth engagement portion.

9. A cap frame comprising:

a body member including a curved wall, the curved wall having an arc shape and extending in a particular direction;

a retaining member configured to, in a state where the retaining member is attached to the body member, hold a cap in cooperation with the body member to sandwich the cap therebetween, the retaining member including:

a clamping portion made of elastic material, the clamping portion configured to, in the state where the retaining member is attached to the body member, be elastically deformed in conformance with the curved wall and press, toward the curved wall, the cap sandwiched between the curved wall and the clamping portion; and a first engagement portion and a second engagement portion disposed at end portions of the clamping portion in the particular direction in the state where the retaining member is attached to the body member;

an attaching portion disposed at at least one of the body member and the retaining member, the attaching portion configured to be removably attached to a moving mechanism of an embroidery machine, wherein the body member further includes:

a third engagement portion and a fourth engagement portion configured to:

engage the first engagement portion and the second engagement portion, respectively, of the retaining member;

in a case where the third engagement portion and the fourth engagement portion are in engagement with the first engagement portion and the second engagement portion, respectively, of the retaining member with the clamping portion conforming to the curved wall, restrict the retaining member and the body member from moving relative to each other, thereby fastening the retaining member to the body member in conformance with the body member; and in a case where the third engagement portion and the fourth engagement portion are out of engagement with the first engagement portion and the second engagement portion, respectively, of the retaining member, allow the retaining member and the body member to move relative to each other;

a first guide portion defining a movable direction of the first engagement portion as a first guide direction toward the third engagement portion and a direction opposite to the first guide direction; and a second guide portion defining a movable direction of the second engagement portion as a second guide direction toward the fourth engagement portion and a direction opposite to the second guide direction; and a switch member configured to change respective positions of the third engagement portion and the fourth engagement portion between an engaged position at which the third engagement portion and the fourth engagement portion are capable of engaging the first engagement portion and the second engagement portion, respectively, and a disengaged position at which the third engagement portion and the fourth engagement portion are incapable of engaging the first engagement portion and the second engagement portion, respectively.

* * * * *